US006249299B1

(12) United States Patent
Tainer

(10) Patent No.: US 6,249,299 B1
(45) Date of Patent: Jun. 19, 2001

(54) SYSTEM FOR PRINTHEAD PIXEL HEAT COMPENSATION

(75) Inventor: Christopher Michael Tainer, Strongsville, OH (US)

(73) Assignee: Codonics, Inc., Middleburg Heights, OH (US)

( * ) Notice: Subject to any disclaimer, the term of this patent is extended or adjusted under 35 U.S.C. 154(b) by 0 days.

(21) Appl. No.: 09/262,988

(22) Filed: Mar. 5, 1999

Related U.S. Application Data

(60) Provisional application No. 60/077,115, filed on Mar. 6, 1998.

(51) Int. Cl.[7] ..... B41J 2/36

(52) U.S. Cl. ..... 347/191; 347/188

(58) Field of Search ..... 347/191, 188; 400/120.11

(56) References Cited

U.S. PATENT DOCUMENTS

| | | | | |
|---|---|---|---|---|
| 4,305,080 | | 12/1981 | Cunningham et al. | 347/195 |
| 4,343,986 | | 8/1982 | Mitani et al. | 347/204 |
| 4,415,904 | | 11/1983 | Inui et al. | 347/195 |
| 4,573,058 | | 2/1986 | Brooks | 347/191 |
| 4,758,966 | | 7/1988 | Brooks et al. | 347/191 |
| 4,782,202 | | 11/1988 | Sawae et al. | 219/68 |
| 4,801,948 | | 1/1989 | Kato | 347/184 |
| 4,878,065 | | 10/1989 | Fukushima et al. | 347/195 |
| 4,912,485 | | 3/1990 | Minowa | 347/186 |
| 5,006,866 | | 4/1991 | Someya | 347/196 |
| 5,066,961 | | 11/1991 | Yamashita | 347/194 |
| 5,066,967 | | 11/1991 | Yamamoto et al. | 347/177 |
| 5,068,674 | | 11/1991 | Sato et al. | 347/62 |
| 5,115,252 | | 5/1992 | Sasaki | 347/195 |
| 5,377,159 | | 12/1994 | Endo | 347/195 |
| 5,444,464 | | 8/1995 | Endo | 347/195 |
| 5,469,068 | * | 11/1995 | Katsuma | 324/678 |
| 5,469,203 | * | 11/1995 | Hauschild | 347/190 |
| 5,483,273 | | 1/1996 | Fujimoto et al. | 347/195 |
| 5,543,828 | | 8/1996 | Minowa | 347/195 |
| 5,548,688 | | 8/1996 | Wiklof et al | 358/1.8 |
| 5,608,333 | | 3/1997 | Hayashi | 324/711 |
| 5,608,442 | * | 3/1997 | Bennefeld et al. | 347/211 |
| 5,623,297 | | 4/1997 | Austin et al. | 347/194 |
| 5,625,401 | | 4/1997 | Wiklof et al. | 347/208 |
| 5,633,671 | | 5/1997 | Watanabe | 347/192 |
| 5,644,351 | | 7/1997 | Matsumoto et al. | 347/194 |
| 5,714,995 | | 2/1998 | Wiklof et al. | 347/208 |
| 5,796,420 | * | 6/1998 | Kaerts et al. | 347/188 |

FOREIGN PATENT DOCUMENTS

| | | |
|---|---|---|
| 0601658 | 6/1994 | (EP) . |
| 542705 | 2/1993 | (JP) . |
| 5147252 | 6/1993 | (JP) . |
| 5169709 | 7/1993 | (JP) . |

OTHER PUBLICATIONS

Image Printing Digest, vol. 3, No. 1, Winter 1996, "Atlantek Offers Independent Consumable Testing Service".

* cited by examiner

*Primary Examiner*—N. Le
*Assistant Examiner*—K. Feggins
(74) *Attorney, Agent, or Firm*—Pillsbury Winthrop LLP

(57) ABSTRACT

A thermal imaging system for compensating for the temperature dependent changes in thermal elements of a thermal printhead is disclosed. Specifically, the thermal imaging system generates a temperature or energy dependent profile of the resistances of each thermal element which makes up the thermal printhead. Based upon this profile, the imaging system estimates the resistances of thermal elements based upon a pixel density to be transferred to media. Based upon the estimated resistances, the imaging system adjusts the amount of energy to be applied to particular thermal elements for transferring a pixel having a density which more closely approximates the density of a corresponding pixel in a desired image.

28 Claims, 14 Drawing Sheets

SYSTEM FOR PRINTHEAD PIXEL HEAT COMPENSATION

This application claims the benefit of the filing date of U.S. Provisional Patent Application No. 60/077,115, filed on Mar. 6, 1998, under 35 U.S.C. § 119 (e).

BACKGROUND

1. Field of the Invention

The disclosed embodiments relate to thermal imaging systems. In particular, the disclosed embodiments relate to methods and apparatuses for transferring images to media which may be applicable to a direct thermal or thermal transfer processes including dye diffusion.

2. Related Art

A typical thermal imaging system includes a printhead formed by a linear array of thermal elements having density of about 200 to 600 thermal elements per inch. Such a printhead may be used for direct thermal printing or by thermal transfer dye diffusion printing. In direct thermal printing, media having a thermal responsive surface is brought into contact with the printhead and translated over the printhead. While the media is translated over the printhead, thermal elements on the linear array are selectively heated at intervals of about five to twenty-four milliseconds to transfer pixels to the media which correspond to pixels in a desired image. In the dye diffusion process, a donor ribbon and receiver media are translated together over the printhead, the donor ribbon being between the printhead and the receiver media. While the donor ribbon and receiver media are translated over the printhead, the individual thermal elements on the linear array are selectively heated at intervals of about five to twenty-four milliseconds to transfer dye from the donor ribbon to the receiver media to form pixels corresponding to pixels in a desired image.

Each thermal element in either the direct thermal or the dye diffusion process may transfer a pixel image having shades of color or gray between blank (with an unheated thermal element) and opaque (with a fully heated thermal element). Thus, the system selectively heats a thermal element in the linear array to a certain level depending upon the shade of color or gray of the pixel in the desired imaged.

Each of the thermal elements in the linear array includes a resistance and an imaging surface. The imaging system includes a circuit which applies a voltage or current to each of the thermal elements to heat it to a level to transfer a pixel which most closely approximates the shade of color or gray for the pixel in the desired image. A problem arises in existing imaging systems of these types in that, due to manufacturing tolerances, the resistance of the individual thermal elements varies from thermal element to thermal element in the linear array. Since the power applied to each element is related to the resistance associated therewith (i.e., $P=V^2/R$ and $P=I^2R$), the imaging system may apply too little or too much power to a particular thermal element to heat it to a desired level. This results in imaging from thermal elements which may be generally too hot or too cold. Also, compounding with the effects of the differences in resistance from thermal element to thermal element in the linear array, the resistance of each of the thermal elements changes over time as the printhead is used. This causes further distortions in the transferred pixel levels of color or gray.

Additionally, as media is translated over the printhead, thermal elements are repeatedly turned on and off to transfer images to media. In doing so, the imaging system heats the particular thermal elements each time it is to transfer a pixel.

Thus, prior to receiving the voltage/current, the imaging surface of any particular thermal element may be cold (e.g., the imaging system has not powered the thermal element for a long time) or the thermal element may be still warm from being heated in the previous five to twenty-four millisecond imaging interval. Thus, in addition to distortions in pixel color or gray level resulting from resistance variances, there may be further distortions due to an historical powering of the thermal elements.

SUMMARY

An object of an embodiment of the present invention is to provide a thermal imaging system with improved imaging quality.

Another object of an embodiment of the present invention is to provide a method and system of applying a proper amount of energy to a thermal element in a thermal printhead in accordance with a level of color or gray of a pixel in a desired image.

It is yet another object of an embodiment of the present invention to provide a method of accommodating for the changes and variations in the resistances associated with thermal elements in a thermal imaging printhead to improve imaging quality in a thermal imaging system.

Briefly, an embodiment of the present invention is directed to a method of calibrating a thermal printhead incorporated in an imaging system for transferring images to media. The printhead includes a plurality of thermal elements and each of the thermal elements has a pixel imaging surface and an associated resistance. The method comprises measuring the resistance of at least one thermal element while at a plurality of temperatures or energy levels to provide an associated plurality of resistance measurements associated with the at least one thermal element. The method then involves establishing or maintaining a temperature or energy dependent resistance profile for the at least one thermal element based upon the plurality of resistance measurements associated therewith. The resulting temperature or energy dependent resistance profile may then reflect variations of the resistance of the thermal element over at least a portion of operational temperature or energy range of the at least one thermal element.

An imaging system may transfer pixels on a line by line basis through applying an amount of energy to thermal elements corresponding to the levels of color or gray of pixels in a desired image as media is translated over the printhead. Using the energy or temperature dependent resistance profile for a particular thermal element, an imaging system may accurately determine a proper amount of energy to be applied to the thermal element to transfer pixels to a media surface having a pixel density which more closely approximates the level of color or gray of the corresponding pixels in a desired image.

Another embodiment of the present invention is directed to a method of transferring an image to media from a thermal printhead, wherein the printhead includes a plurality of thermal elements, and wherein each of the thermal elements has a pixel imaging surface and an associated resistance. The method comprises selecting thermal elements to be heated at the image surface to provide an image on the media; estimating the temperature or energy level of at least the selected thermal elements based upon energy previously applied to the thermal element; and calculating an amount of energy to be applied to each of the selected thermal elements based upon these estimates for the selected thermal element, the desired energy for marking pixels with the proper density and a temperature or energy dependent resistance profile associated with the selected thermal element.

By applying an amount of energy based upon the resistance profile and the estimated heat at the pixel imaging surface, the resulting pixel transferred to the media has a level of gray or color which closely approximates that of the corresponding pixel in the desired image.

DETAILED DESCRIPTION

According to an embodiment of the present invention, a manufacturing method reduces or eliminates the effects of changes in the resistance of individual thermal elements in a thermal printhead resulting from use of the printhead in a thermal imaging system. Such a printhead may be of the type which includes a linear array of thermal elements. This manufacturing method includes a repeated application of energy to individual thermal elements over time, prior to the installation of the printhead in the thermal imaging system. Resistances of the thermal elements change rapidly when the printhead is new and changes very little per use after the printhead has been used extensively. This application of current/voltage or heat to the thermal elements continues until the changes in the resistance (over time in use) of the thermal elements diminish to a certain level. Once the resistances of the thermal elements are "burned in " to a suitable level, the resistance of each of the thermal elements in the linear array is measured.

The process of measuring the resistances of the thermal elements is herein referred to as "calibration. " The calibration process applies energy to each thermal element to measure the associated resistance. In a preferred embodiment, by using one or several different levels of energy for measurement, the resistance is measured for each thermal element at various temperatures or energy levels. These measurements provide a temperature or energy dependent resistance profile for each thermal element in the printhead. The image system incorporating the pre-treated printhead preferably uses this resistance profile to apply the proper amount of energy to a selected thermal element (to provide the desired level of heat at the imaging surface for transferring a pixel image which closely approximates the desired level of color or gray).

In another embodiment of the present invention, after the printhead is installed and in use, the imaging system may update the temperature or energy dependent resistance profile to compensate for any additional changes in the resistances after the printhead is installed. In an alternative embodiment, the imaging system also maintains a history of the application of energy to the thermal elements to heat the thermal elements for transferring pixels. Thus, in effect, the imaging system estimates the extent to which a particular thermal element is already heated or energized. Based upon the temperature or energy dependent resistance profile and the history of the application of energy to a particular thermal element, the imaging systems determines the proper amount of energy to be applied to a thermal element to heat the imaging surface to the desired temperature to transfer a pixel which most closely approximates the level of color or gray of the pixel in the desired image.

Figure 1:
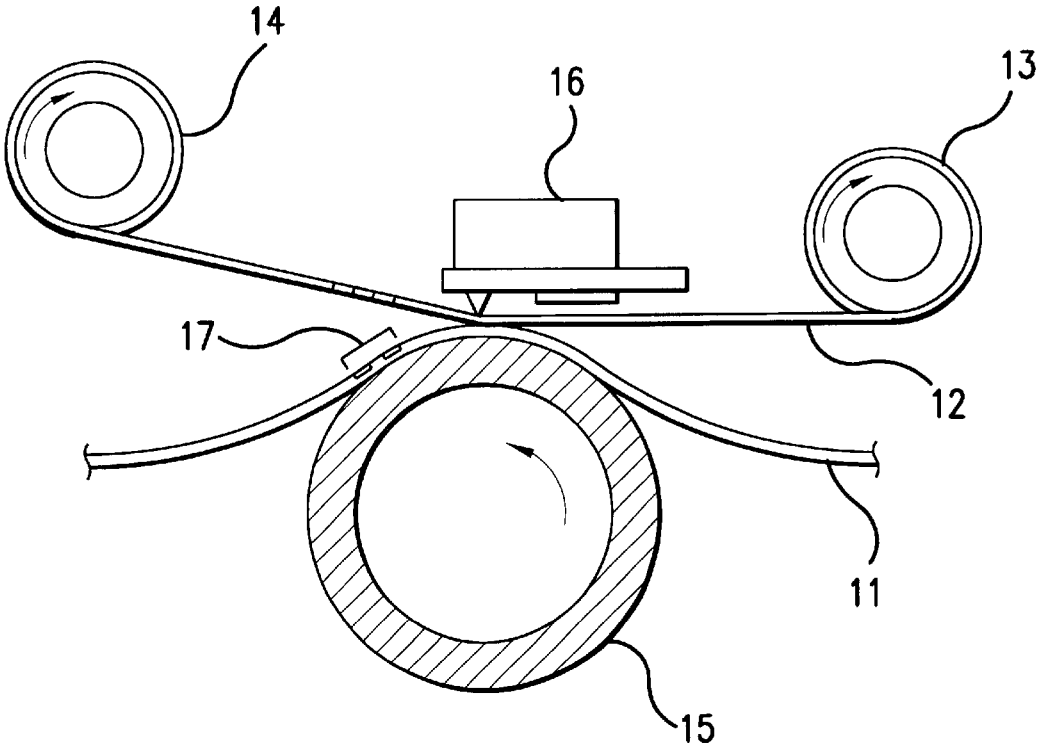
FIG. 1 shows a system for transferring an image to media according to an embodiment.

FIG. 1 shows a thermal printing system according to an embodiment which prints a line of pixels at time intervals onto a receiver media 11 by thermally transferring dye from a donor ribbon 12. The receiver media 11 may be in the form of a sheet and the donor ribbon 12 may be in the form of a web which is driven by a supply roller 13 onto a take up roller 14. The receiver media 11 is secured to a rotatable drum or platen 15, driven by a drive mechanism (not shown) which continuously advances the platen 15 and the receiver media sheet 11 past a stationary thermal printhead 16. The thermal printhead 16 presses the donor ribbon 12 against the receiver media 11 and receives the output of driver circuits (not shown).

The thermal printhead 16 preferably includes a plurality of thermal elements equal in number to the number of pixels in the data present in the line memory. Thus, the transfer of dye from the donor ribbon 12 is performed on a line-by-line basis, with the thermal element resistors oriented in a linear array for sequential transfer of the dye. According to the embodiment, these resistors are energized by voltage pulses controlled in accordance with a desired density of corresponding pixels in a desired image.

While FIG. 1 shows an embodiment directed to a dye diffusion process of transferring an image 17 to a receiver media 11, embodiments of the present invention may also be directed to a thermal wax transfer process or to direct thermal transfer process from the thermal printhead 16 to thermal reactive media. In such a direct thermal transfer embodiment, there would be no donor ribbon 12, and corresponding supply roller 13 and take up roller 14. The thermal printhead 16 would then press directly on the thermal reactive media against the platen 15 while the platen 15 rotates to drive the thermal reactive media past the thermal printhead 16. This occurs while the thermal elements in the linear array are sequentially heated to transfer the image 17 to the thermal reactive media.

Figure 2:
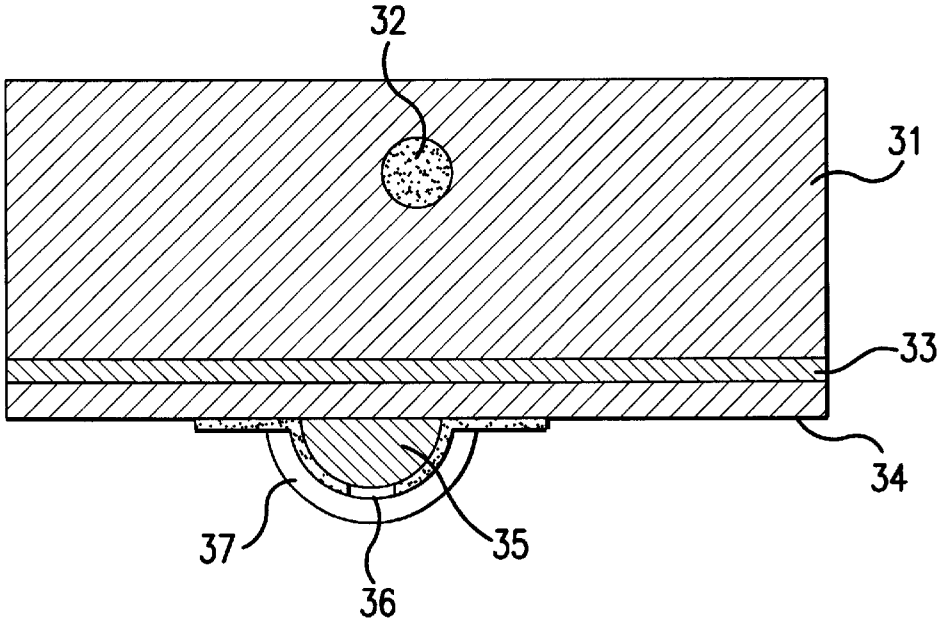
FIG. 2 shows a cross-section of a thermal printhead shown in FIG. 1.

FIG. 2 shows a cross-section of an embodiment of the thermal printhead 16 shown in FIG. 1. A heat sink 31 includes a temperature sensor 32 disposed therein. The heat sink 31 is adhered to a ceramic substrate 34 by a bonding layer 33. Formed over a side of the ceramic substrate 34 opposite the heat sink 31 is a glazen bulb 35. A thermal element 36 is formed on the glazen bulb 35 and a wear resistant layer 37 is formed over the thermal element 36. According to embodiment, there may be up to 2,560 thermal elements 36 formed in a linear array at a density of about 300 per inch. As discussed above, the resistances across the thermal element 36 change over time due to thermal oxidation of the material forming the thermal elements 36. Thus, according to embodiment, the printhead is pre-aged by applying energy in the form of current, voltage, or direct heat to the thermal elements 36 to accelerate the changes in resistance. Thus, as the temperature of the thermal elements 36 is raised over time, changes in the resistance of the thermal elements 36 for subsequent uses is minimized.

Figure 3:
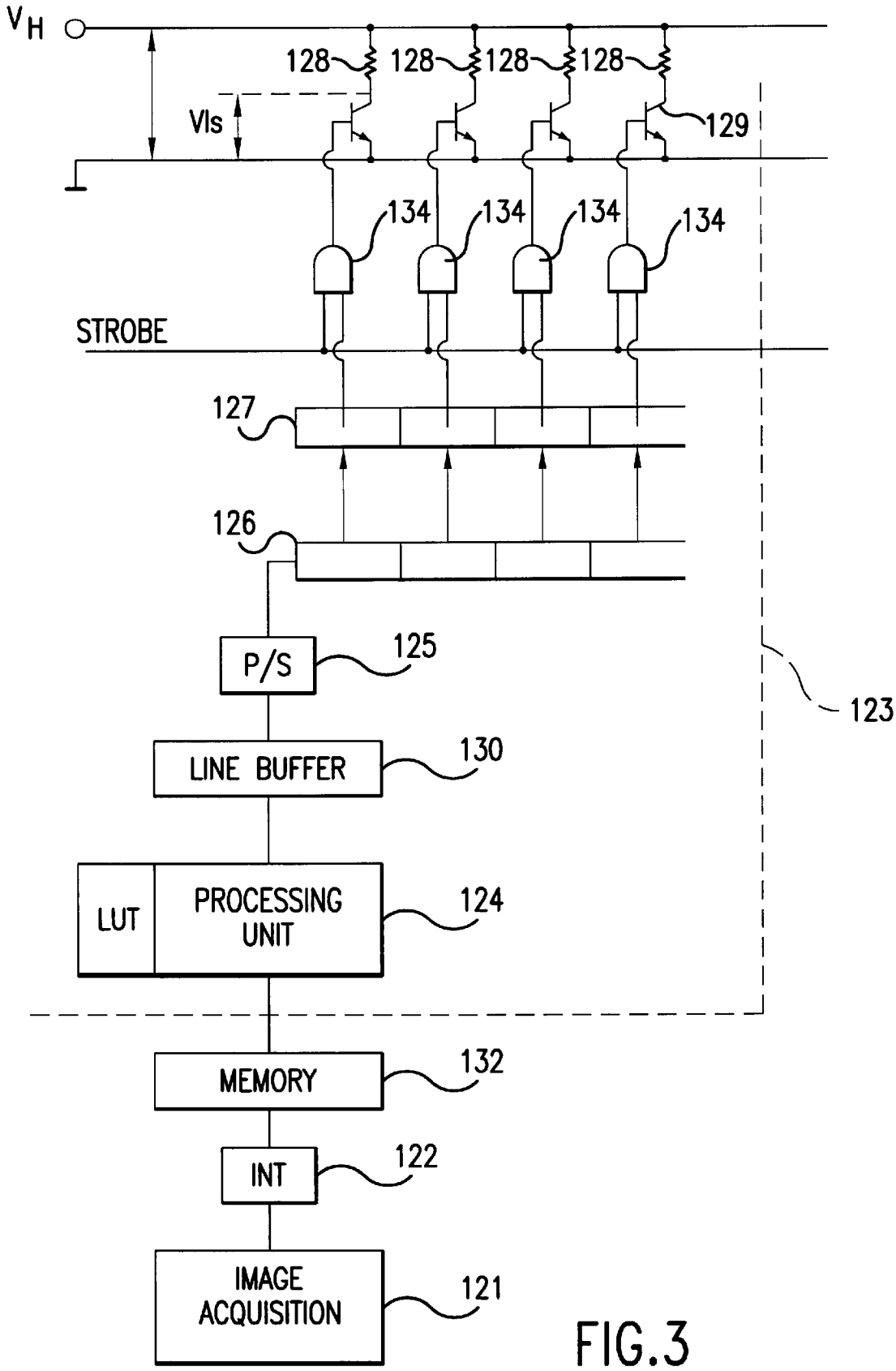
FIG. 3 shows a schematic diagram of a first embodiment of a printhead control circuit.

FIG. 3 shows an embodiment of control circuitry used to provide power to the thermal elements 36 (FIG. 2) in the thermal printhead 16 (FIG. 1). An image acquisition section 121 obtains a digital representation of a desired image. A digital interface 122 receives the digital representation and provides it to a recording unit 123 which may be adapted to provide control signals for either direct thermal transfer or dye diffusion transfer. The recording unit 123 then controls the thermal printhead 16 to provide at each thermal element a dot having a density value corresponding with a pixel in the digital representation. This pixel in the desired image corresponds with a thermal element on the linear array of thermal elements on a printhead at a point in time.

The processing unit 124 provides a parallel output to a line buffer 130. The parallel output of the processing unit 124 corresponds with a line of pixels in the desired image. A parallel to serial conversion circuit 125 provides a serial stream of serial bits to a shift register 126. The data loaded to the shift register 126 thus represents energy to be applied for transferring a line of pixels to the media. The bits stored in the shift register 126 are then supplied in parallel to associated inputs of a latch register 127, while another line of bits corresponding to subsequent application of energy to the thermal elements is sequentially clocked into the shift register 126.

Resistors 128 correspond with resistances across the individual thermal elements 36 (FIG. 2) oriented in a linear array. Upper terminals are coupled to a positive head voltage $V_H$ of about 15 volts, while lower terminals of the resistors 128 are coupled to the collectors of switch transistors 129. The switch transistors 129 have emitters coupled to ground and are selectively switched on by a high state from AND gates 134. The AND gates 134 receive a strobe signal at a first terminal and outputs of the latch register 127 to provide serial data to switch the switching transistors 129 on and off to provide sequential pulses of the head voltage $V_H$. In this manner, resistors 128 are energized to apply heat at pixel regions corresponding to the desired image. Such a system is similarly described in U.S. Pat. No. 4,573,058 with reference to FIG. 1 at column 2, line 57 through column 3, line 48, incorporated herein by reference.

Figure 4A:
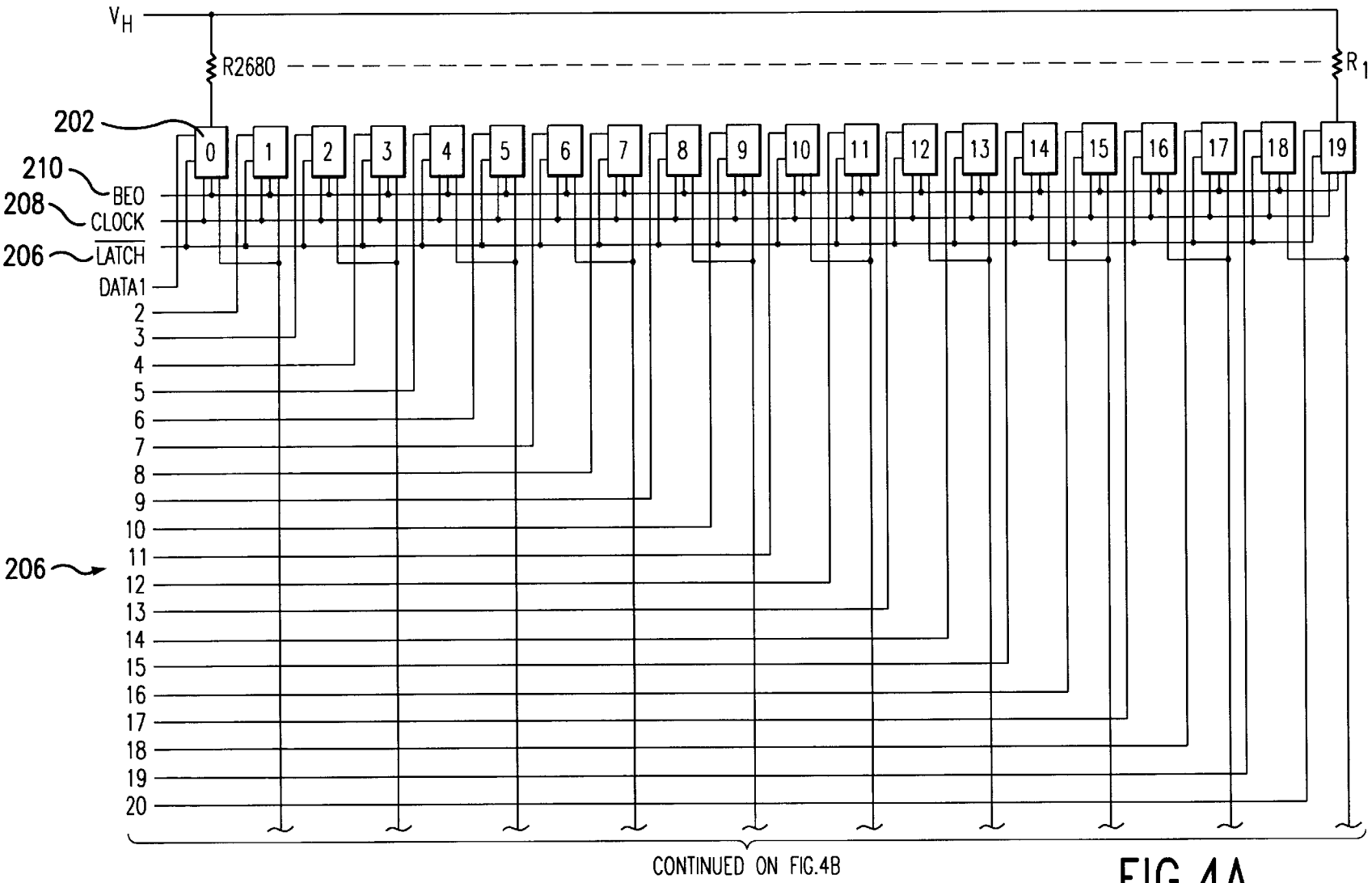
FIGS. 4A & 4B shows schematic diagram of a second embodiment of a printhead control circuit.
Figure 4B:
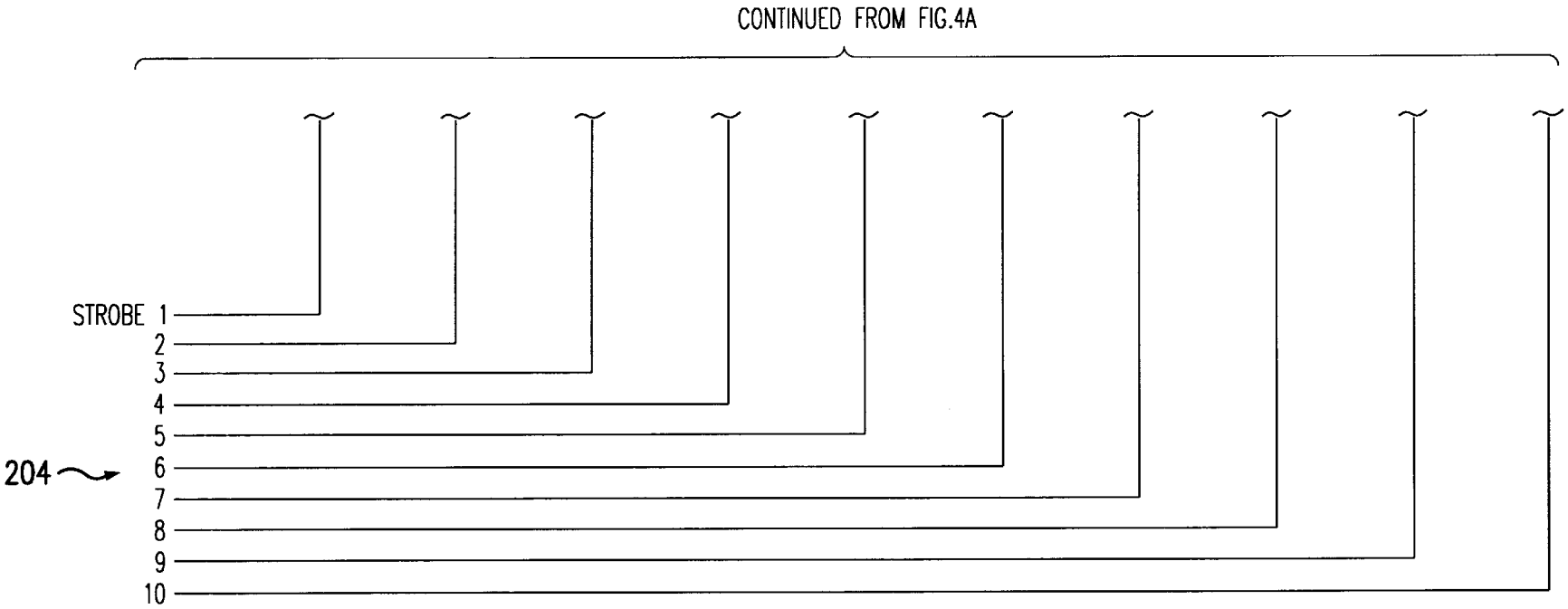

FIG. 4 shows another embodiment of driver circuitry for providing power to the thermal elements 36 shown in FIG. 2. Resistors R1 through R2560 are coupled to head voltage $V_H$ at a first terminal and to a transistor switch (not shown) in a corresponding IC unit 202. As shown in FIG. 4, there are twenty such IC units 202. Thus, each IC unit 202 is coupled to 128 thermal element resistors. Each of the IC units 202 receives a corresponding data line 206, an inverted strobe line 204, and inverted latch line 206, a clock signal 208, and a BEO signal 210.

Figure 5:
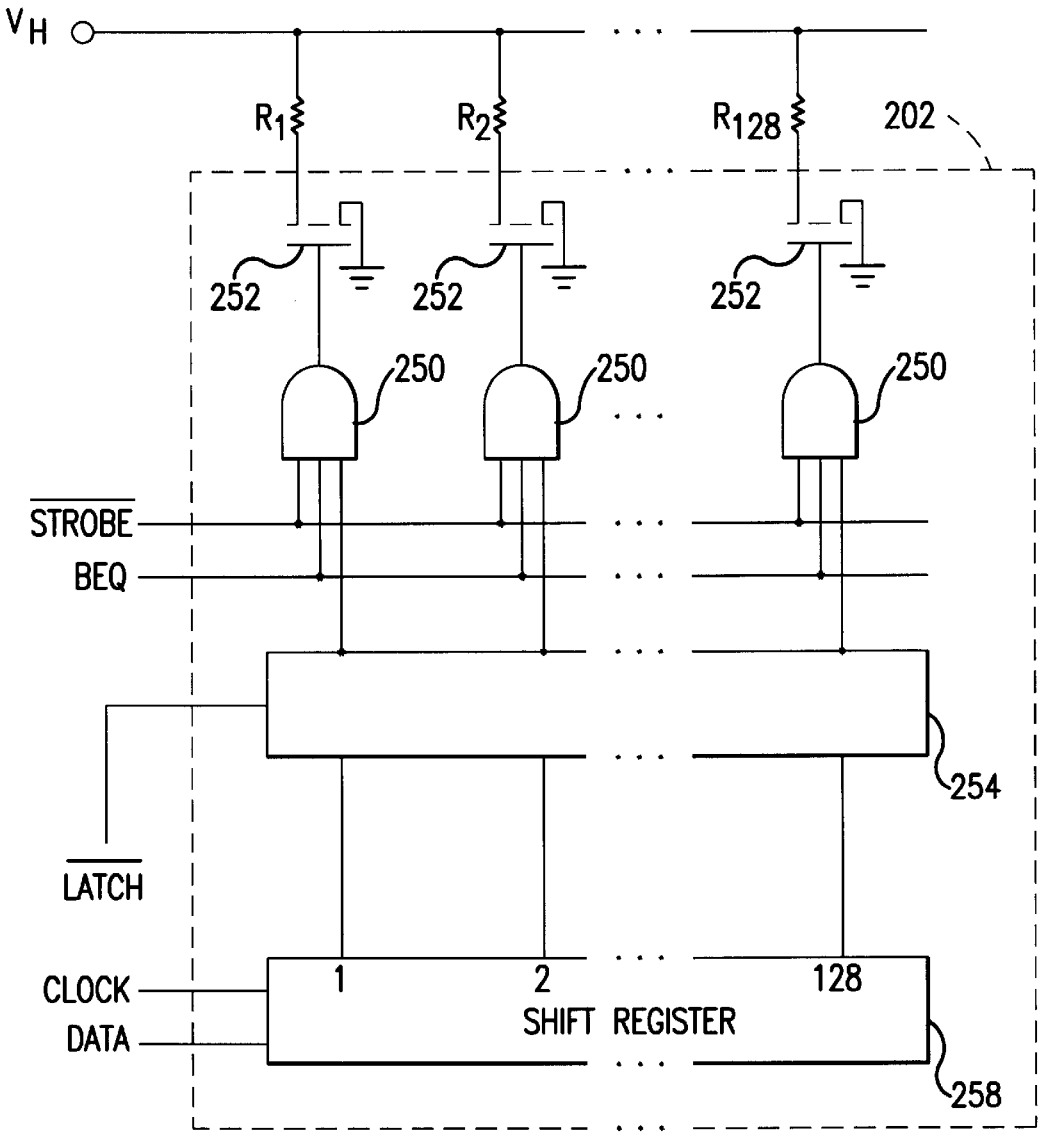
FIG. 5 shows a schematic diagram of an embodiment of a representative IC unit in the embodiment of FIG. 4.

FIG. 5 shows an embodiment of a representative IC unit 202 shown in FIG. 4. The IC unit 202 includes 128 switch transistors 252 which receive a signal at a gate terminal from a corresponding AND gate 250 to provide a pulsed voltage from head voltage $V_H$. The AND gates 250 receive inputs from an inverted strobe signal, a BEO signal, and a signal from a latch circuit 254. As shown in FIG. 4, the IC unit 202 receives a data line and a clock signal. These lines are received at the shift register 258. Data is serially clocked to fill the shift register 258 with 128 bits, each bit corresponding to one of the 128 thermal elements associated with the IC unit 202.

After the shift register 258 is filled, the latch circuit 254 latches all of the data in the shift register 258 so that the shift register 258 can then receive the next 128 bits. Under control of the inverted strobe signal, the AND gates 250 provide sequential pulses of the head voltage $V_H$ to their associated thermal elements, each pulse controlled by a bit received from the latch. The sequential pulses are based upon a predetermined energy level to provide to the thermal elements in an image line to provide a pixel density which most closely approximates the density of a corresponding pixel in the desired image.

As discussed above, the thermal elements 36 (FIG. 2) are preferably pre-aged by applying energy to heat them over a period of time to accelerate the thermal oxidation of the resistive material. This may be accomplished by, for example, pre-loading the latch 254 with "1's " to provide pulses on 30 millisecond cycles at a 70% duty cycle. Power is preferably applied to the thermal elements in this fashion over a sufficient time such that the resistance of the thermal elements will vary only marginally over the next 50,000 prints.

According to embodiment, after the thermal printhead 16 is sufficiently pre-aged, a temperature dependent resistance profile is established for each of the thermal elements 36. This is performed by applying a plurality of high precision currents through, or high precision voltages across, the resistances of the thermal elements and measuring the voltage across the resistance. Providing different levels of current through, or voltage across, the resistance of the thermal elements energizes the thermal elements to different levels which corresponds to operating temperatures.

The resistances of each of the thermal elements is preferably measured one at a time. In one embodiment, a thermal element to be measured is decoupled from the head voltage $V_H$ so that one or more high precision constant currents may be applied to the isolated thermal element. The current is preferably applied long enough for the temperature or energy level of the thermal element to rise to a steady state. At this point, the resulting voltage across the thermal element is measured. Based upon the measured voltage and the known high precision current, the resistance at this temperature or energy level is estimated using Ohm's law.

In another embodiment, the thermal elements may be energized by applying a high precision DC voltage across the isolated thermal element until reaching a steady state temperature or energy level. Then, the current through the isolated thermal element is measured using conventional techniques. The resistance at this temperature or energy level may then be estimated using Ohm's law based upon the measured current and the known high precision voltage.

In another embodiment, a pulse-width-modulated signal may be applied to thermal elements and the resulting DC current measured. The duty cycle of the pulse-width-modulated signal may be varied allowing measurements to be taken at different enegerization levels. Alternatively, a controlled voltage from a capacitative discharge may be applied across the resistances of the thermal elements to provide different average voltage levels resulting in different energization levels.

In the imaging system, a processor digitally represents in a memory the desired image to be transferred to the media as rows of grayscale or colorscale pixels. Each pixel is to be transferred by a corresponding thermal element on the printhead having a position corresponding to the pixel within the row of the image, relative to the thermal printhead. According to an embodiment, the processor associates each pixel with at least one desired image intensity value (level of grayness or color) ranging from 0 to 255.

In a conventional thermal imaging system, a thermal print engine, such as the XLS8680 sold by Eastman Kodak Co., includes a thermal printhead (similar to the TDK LV541H thermal printhead) and driver circuitry as described above with reference to FIGS. 4 and 5. Such a thermal print engine may also include an interface to the data lines which loads data to the shift registers 258 for providing sequential pulses of the head voltage $V_H$ across the thermal elements. This interface determines the data to be loaded to the shift registers 258 based upon the desired image value. This is accomplished by converting the desired image value to a pulse stream which provides a value-to-print density transfer function in a fashion commonly known in the art.

In an embodiment of the present invention, a desired image value is converted to an intermediate energy index for purposes of allowing convenient compensation for variations in thermal element resistance. To perform this translation when printing from the Kodak XLS 8680 print engine, the preferred conversion information for the desired media is preferably uploaded from the printer using the RawSenseTableGet and DmaxGet engine commands. Using this information, a transformation lookup table is preferably created for mapping image values 0 through 255 into energy indices such that image vallues 0 to 255 produce a linear optical density transfer function from Dmax to Dmin.

The energy index is modeled as being substantially proportional to the energy applied to the thermal elements during printing. The relationship between the energy index and the energy applied to the thermal elements may also be modeled according to a curve fitted to experimental data samples. According to the proportional relationship model, an energy index of zero produces zero energy within the thermal element during printing. An energy index of 255 produces a maximum level of energy during printing which is sufficient to mark the media with the required maximum optical density.

Once a pixel's energy index has been determined, it is preferably adjusted according to the predicted resistance of the thermal element which is to transfer the pixel to the media. Such a predicted resistance is preferably compared with the average of all the predicted resistances across the printhead. A predicted resistance that is lower than the average will generate more power than the average, and therefore, its energy index is preferably reduced to compensate. The converse is true for predicted resistances that are greater than the average. According to an embodiment, this modification is performed on each pixel as follows:

$$Enew_i = Eindex_i\left[1 - KR\cdot\left(\frac{\overline{Rp} - Rp_i}{\overline{Rp}}\right)\right] \quad (1)$$

where: $Eindex_i$=energy index of $i^{th}$ dot on printhead

KR=media- and printer-specific constant $\overline{Rp}$=the mean of the predicted resistances for all the thermal elements across the printhead at imaging temperature or energy level $Rp_i$=the predicted resistance of the $i^{th}$ thermal element on the printhead $Enew_i$=new energy index of $i^{th}$ pixel, compensated for the predicted resistance of the $i^{th}$ thermal element The compensated image, consisting of rows of pixels, each with an adjusted energy index $Enew^i$, is then provided to the thermal print engine for printing. The print engine preferably converts the desired energy indices to pulse streams to be applied to thermal elements for printing.

In the preferred embodiment, energy indices are converted to pulse streams as compared with a direct conversion of image values to pulse streams. Such an intermediate conversion permits modifyring the pulse stream for heat compensation techniques described herein. To employ such a scheme in the Kodak XLS 8680 print engine, the Calibration Toggle Option and the Head Correction Option are preferably disabled. The preferred system replaces the disabled functions with the function for converting to energy indices and the function for compensating thermal element resistances described above. These functions are preferably applied to the image data prior to sending to the print engine for printing.

In alternative embodiments, in addition to compensating energy indices to account for variations in the predicted resistances of the thermal elements, the energy indices may also be adjusted to account for driver chip ground losses. Energy levels may be further compensated to account for the effects of residual energy applied to thermal elements in previous print lines. By maintaining a history of the energy applied to a particular element in previous print lines, the processor can, in effect, predict the temperature or residual energy of the thermal element and adjust energy indices accordingly to provide the temperature at the thermal element which most closely corresponds the density of the pixel in the desired image. Such techniques for adjusting energy indices to compensate energy previously applied to the thermal elements are well known in the art and described in U.S. Pat. Nos. 4,305,080; 4,878,065; 4,912,485; 5,006,866 and 5,066,961. Such an adjustment to the energy indices of a thermal element for residual energy or driver chip ground losses may be incorporated into the energy indices prior to adjustments according to the predicted resistance of that thermal element. Alternatively, these adjustments of the energy index for the thermal element may be performed after the aforementioned adjustment according to the resistance profile.

According to one embodiment, the resistance of each thermal element is measured at room temperature and at elevated temperatures is estimated based on resistance measurements taken at low and high currents. A "high-energy " measurement of the resistance of the thermal element may then be taken while the high current is applied and a "low-energy " measurement may be taken while the low current is applied. The low-energy measurement is made at approximately 1.0 mA, generating approximately 4.0 mW of power in a typical thermal element resistance of about 4.0 kOhms. This power level is small enough that it does not substantially raise the temperature or energy level of the thermal element while the measurement is being taken. It is therefore considered to be a room-temperature resistance measurement. The high-energy measurement is made at approximately 3.0 mA. This generates approximately 36.0 mW of power, creating an elevated temperature within the thermal element during the measurement.

In another embodiment, precision voltages are applied to the thermal element to change the temperature of the thermal element instead of precision currents. The low-energy measurement is made at approximately 5.0V, generating approximately 6.3 mW of power in a typical thermal element. Again, this power level is small enough so that the temperature or energy level of the thermal element is not raised significantly while a measurement is being taken. The high-energy measurement is made at approximately 15.0V which generates approximately 56.3 mW of power to raise the temperature of the thermal element.

Although the high-energy measurement is made at an elevated temperature or energy level, the temperature is not as high as those encountered during imaging. According to an embodiment, the resistance profile of the head is linearly extrapolated for imaging temperatures for each thermal element as follows:

$$Rp_i = Rl_i(1 + KT \cdot \Delta R_i) \quad (2)$$

$$\Delta R_i = \frac{Rh_i - Rl_i}{Rl_i} \quad (3)$$

Where: $Rh_i$=measured resistance of $i^{th}$ element during high-energy measurement $Rl_i$=measured resistance of $i^{th}$ element during low-energy measurement $Rp_i$=a predicted resistance of $i^{th}$ element at imaging temperature or energy level KT=a scaled value which is representative of the temperature or energy level of a thermal element of a specific printer while imaging to a specific type of media The algorithm above assumes that measurements $Rh_i$ and $Rl_i$ are taken for each $i^{th}$ element in the thermal printhead, in which $Rh_i$ and $Rl_i$ correspond to the high- and low-energy resistance measurements, respectively. The value of $\Delta R_i$, in effect, reflects a thermal coefficient of resistance of $i^{th}$ element. $\overline{Rp}$ may then be calculated for equation (1) above by obtaining the average of the estimated resistances of all thermal elements on the printhead at the imaging temperature or energy level.

The benefit of predicting resistance in this way is that the prediction gain, KT, can be fine-tuned for different media types and print speeds. Imaging to different media types (e.g., film versus paper) as well as using different imaging methods (i.e., direct thermal or dye diffusion) results in widely varying temperature or energy levels at the thermal elements. Since these factors affect the temperatures produced during printing, this embodiment may compensate for changes in resistance of the thermal elements for all types of media and printing methods. Thus, the processor in the imaging system may store KT values for each combination of media type and printing method to be used for generating an energy or temperature dependent resistance profile for each thermal element according to equations (2) and (3). Further, with knowledge of the specific energy index $Eindex_i$ the value KT can be determined for each combination of media and printing method, for specific energy level applied to a thermal element. The processor may calculate KT for each energy level for the media and energy level or provide predetermined values in a look-up table.

In alternative embodiments, the resistance of the thermal elements may be measured at more than two temperature/energy levels which may be fitted to a curve. Such resistance measurements may be taken at suitable increments of temperature or energy throughout the entire operational range of the thermal elements. The processor may then maintain the temperature or energy dependent resistance profile in the form of a look-up table having specific energy indices or temperature ranges as an index to the table.

This method can be made to account for print energy on a dot-by-dot basis. The energies required to produce a line of the particular image in question would be used to predict the resistance of each dot, rather than assuming one energy level for the entire head. This provides a refinement over the existing method.

As pointed out above, the high-energy and low-energy measurements of the resistances of the individual thermal elements may be taken by applying either high precision currents or high precision voltages to the individual thermal elements. Either method is suitable for providing the values $Rh_i$ and $Rl_i$ as inputs to equations (2) and (3). A first embodiment for providing the values of $Rh_i$ and $Rl_i$ for each thermal element i using circuitry for generating high precision currents is discussed below with references to FIGS. 7 and 8. A second embodiment for providing the values of $Rh_i$ and $Rl_i$ using circuitry for generating high precision voltages is described below with reference to FIG. 9.

According to an embodiment, the values of $Rh_i$ and $Rl_i$ are determined for each thermal element i once during manufacturing after the printhead has been sufficiently aged. The imaging system receiving the printhead, including processing circuitry for determining the energy indices $Enew_i$, can then be adjusted using these predetermined values $Rh_i$ and $Rl_i$. Such processing circuitry may include, for example, the digital interface 122 and image acquisition section 121 (FIG. 3).

Figure 6:
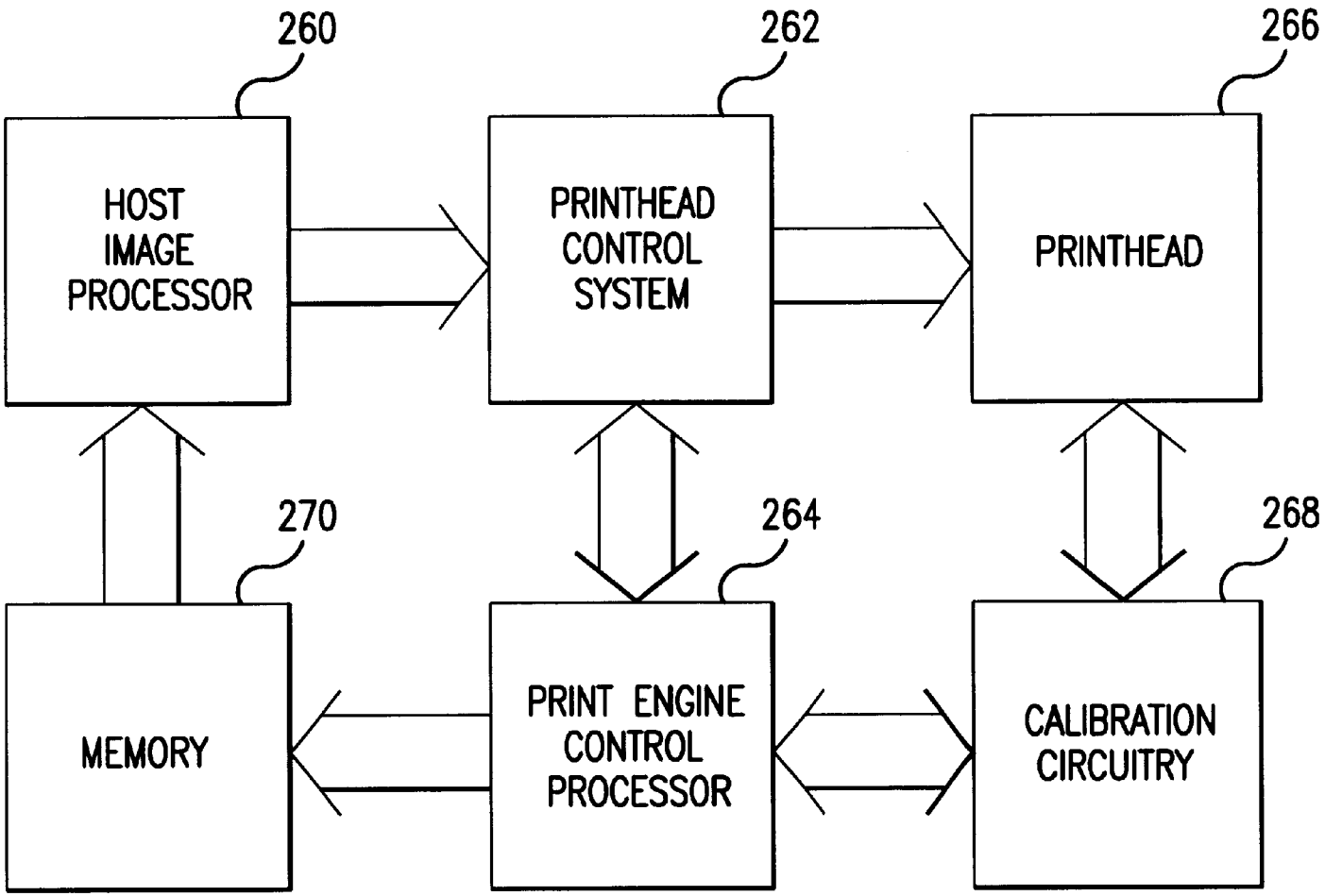
FIG. 6 shows an architecture of a printing system which includes printhead calibration circuitry for calibrating the resistances of thermal elements after installation according to an embodiment.

Alternatively, the printer receiving the factory pre-aged printhead also includes calibration circuitry on-board so that the values of $Rh_i$ and $Rl_i$ can be periodically re-measured as the resistances of the thermal elements continue to change as a result of additional use. FIG. 6 shows an embodiment of a printer architecture which includes printhead calibration circuitry 268 for measuring the resistances $Rh_i$ and $Rl_i$ for each thermal element following installation of the printhead 266. A host image processor 260, such as a DEC/Compaq Alpha™ processor, determines the values of $Enew_i$. A printhead control system 262 provides pulse signals to the printhead 266 to transfer lines of an image onto media in a fashion similar to that described above in reference to the recording unit 123 (FIG. 3).

A print engine control processor 264, such as a digital signal processing circuit sold by Texas Instruments or other suitable microcontroller circuit, provides digital control signals to calibration circuitry 268 and receives digital signals representing measured resistances in response. The print engine control processor 264 writes these measured resistances (including $Rh_i$ and $Rl_i$) to a memory 270 which is accessible by the host image processor 260. The print engine control processor 264 also controls the calibration circuitry 268 to selectively couple to individual thermal elements in the printhead 266 for obtaining high-energy and low-energy resistance measurements. The host image processor 260 then calculates adjusted energy indices from these resistance measurements according to equations (1), (2) and (3).

Figure 7A:
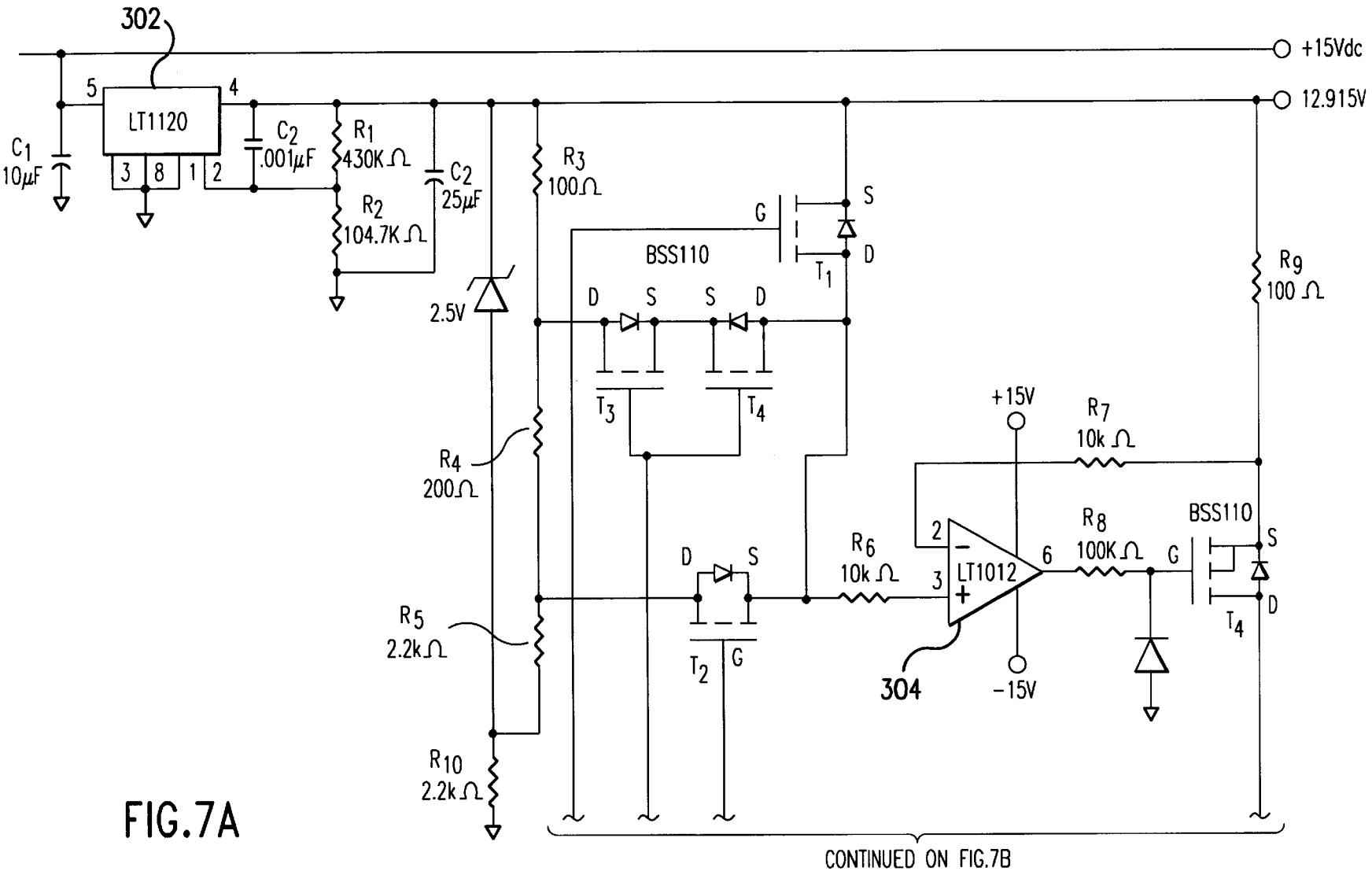
FIGS. 7A & 7B shows a schematic diagram of an embodiment of a high precision current generation circuit for measuring the resistance across thermal elements in the printhead shown in FIGS. 1 and 2 according to a first embodiment.
Figure 7B:
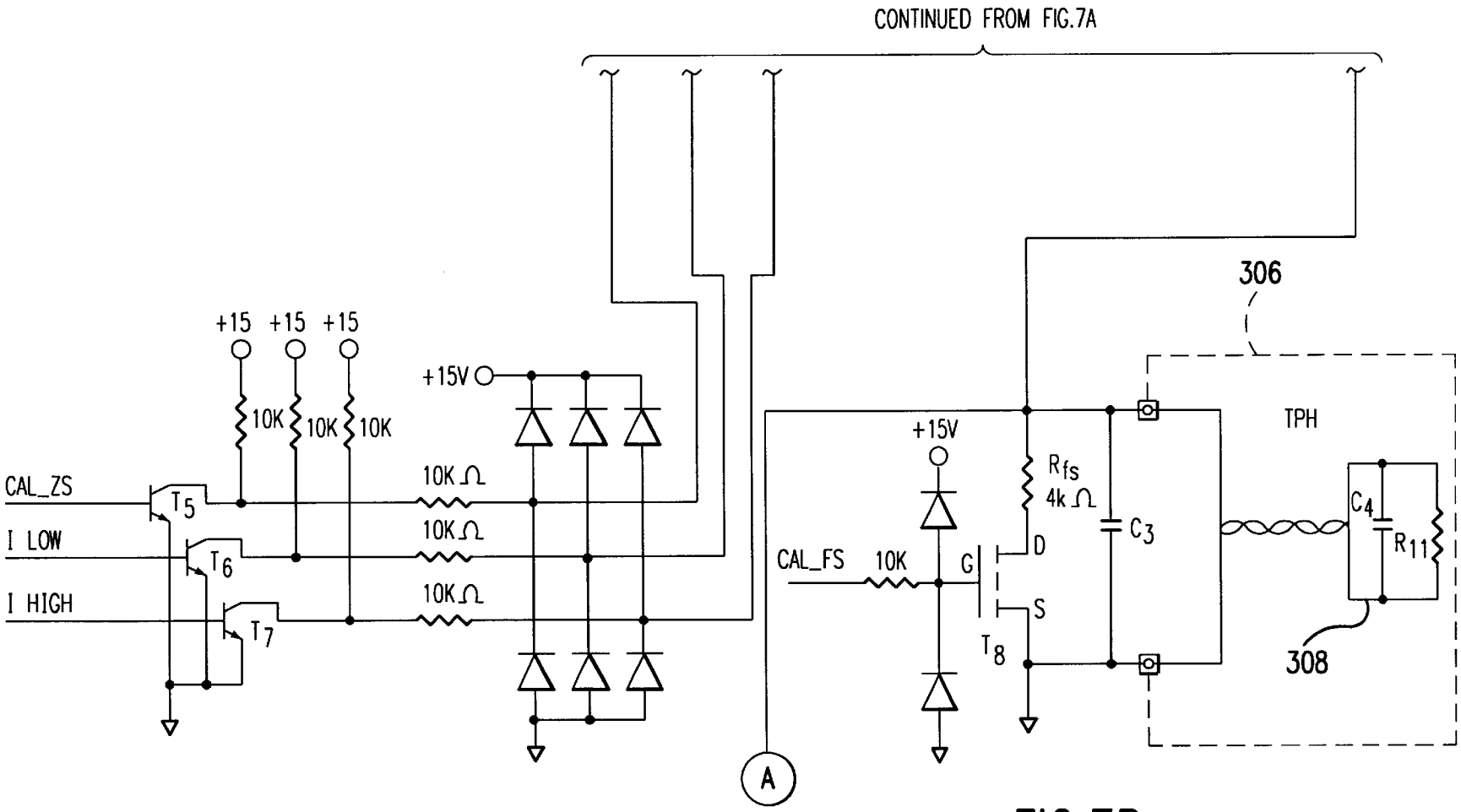

FIG. 7 shows an embodiment of a circuit for generating a high precision current through an isolated thermal element 308 to provide a voltage across the thermal element at A according to a first embodiment for making high-energy and low-energy measurements of the resistance of the thermal element 308. The circuit in FIG. 6 is preferably controlled by digital inputs from control logic (such as a microprocessor or the print engine control processor 264) including $I_{low}$, $I_{high}$, CAL_ZS, and CAL_FS. A high precision voltage regulator circuit 302 (such as an LT1120 integrated circuit sold by Linear Technology) receives a 15 volt DC input and provides an output at a terminal 4 of 12.915 volts. A current drive is controlled by a high precision operational amplifier 304 (such as an LT1012 operational amplifier sold by Linear Technology) which provides an output to a gate terminal of a driver transistor T9. Thus, the output of the operational amplifier 304 controls the current through the source and drain terminals of the transistor T9 which is provided to an isolated thermal element 308 of a thermal printhead 306.

Resistors R3, R4 and R5 form a voltage divider over a 2.5 volt high precision voltage reference. By raising the signal $I_{low}$, switch transistors T3 and T4 are switched on to provide a first voltage to the non-inverting input of the operational amplifier 304. This causes the corresponding voltage at the gate terminal of transistor T9 to generate a current of about 1.0 mA through the thermal element 308. As discussed in greater detail below with reference to FIG. 8, a voltage across the resistance of the thermal element 308 is then measured at terminal A. By lowering the $I_{low}$ signal and raising the $I_{high}$ signal, a second voltage is applied to the non inverting input of the operational amplifier 304 to provide a second gate voltage to the gate of transistor T9 to generate a current of about 3.0 mA through the thermal element 308. The voltage across the thermal element 308 is then measured again at terminal A.

These two currents are preferably applied to the thermal element 308 in intervals which allow the temperature of the thermal element to raise to a steady state or until heat dissipation at the thermal element 308 about equals the energy applied by the current source. Such intervals may be about 0.25 seconds for an application of each of these current levels. After voltages across the isolated thermal element 308 are determined for each of the current levels after reaching the steady state, a different thermal element in the printhead is then isolated for similar voltage measurements.

In alternative embodiments, sensors at the printhead may directly measure the temperature at the isolated thermal element 308 while the resistance is being measured. The processor may then develop the temperature or energy dependent resistance profile based upon the measured resistances and the temperature directly measured.

The signal CAL_ZS and CAL_FS may be periodically raised to calibrate the current source during a calibration procedure. The current generating circuit of FIG. 7 is preferably calibrated at a zero current level and at a full current level. Calibration voltages are provided to the analog to digital circuitry shown in FIG. 8 so that sample voltages across the thermal elements 308 can be adjusted in accordance with the currents measured at calibration. A process of calibrating the current generating circuit is properly performed prior to taking measurements of the resistances across the thermal elements 308. In this procedure, thermal printhead driver circuitry is controlled so as to turn off all switch transistors associated withall thermal elements 308 so that essentially no current current flows into printhead 306. The calibration procedure then proceeds in two parts.

In the first part, $I_{high}$ and $I_{low}$ are set to zero and CAL_ZS and CAL_FS are set to one. In this manner, a switch transistor T1 connects the non-inverting input of operational amplifier 304 to the voltage at pin 4 of the voltage source 302. This provides minimal voltage to the gate terminal of the drive transistor T9 which causes minimal current accross R9. This results in minimal current through, and voltage across, resistor $R_{fs}$. The analog to digital circuitry then samples this voltage and refers to it as a zero calibration current.

In the second part, $I_{high}$ is set to one, $I_{low}$ is set to zero, CAL_ZS is set to zero and CAL_FS is set to one. Here, a switch transistor T2 connects the non inverting input of the operational amplifier 304 to generate the maximum current through the drive transistor T9. The voltage at the gate of switch transistor T8 couples the resistor $R_{fs}$ to receive the current from the drive transistor T9. The analog to digital circuitry then samples this voltage to determine the full current calibration value. The analog to digital circuitry, having calculated the full calibration current and the zero calibration current through the resistor $R_{fs}$, may then scale the current measured across the thermal elements 308 when measuring their respective resistances as discussed above.

Figure 8:
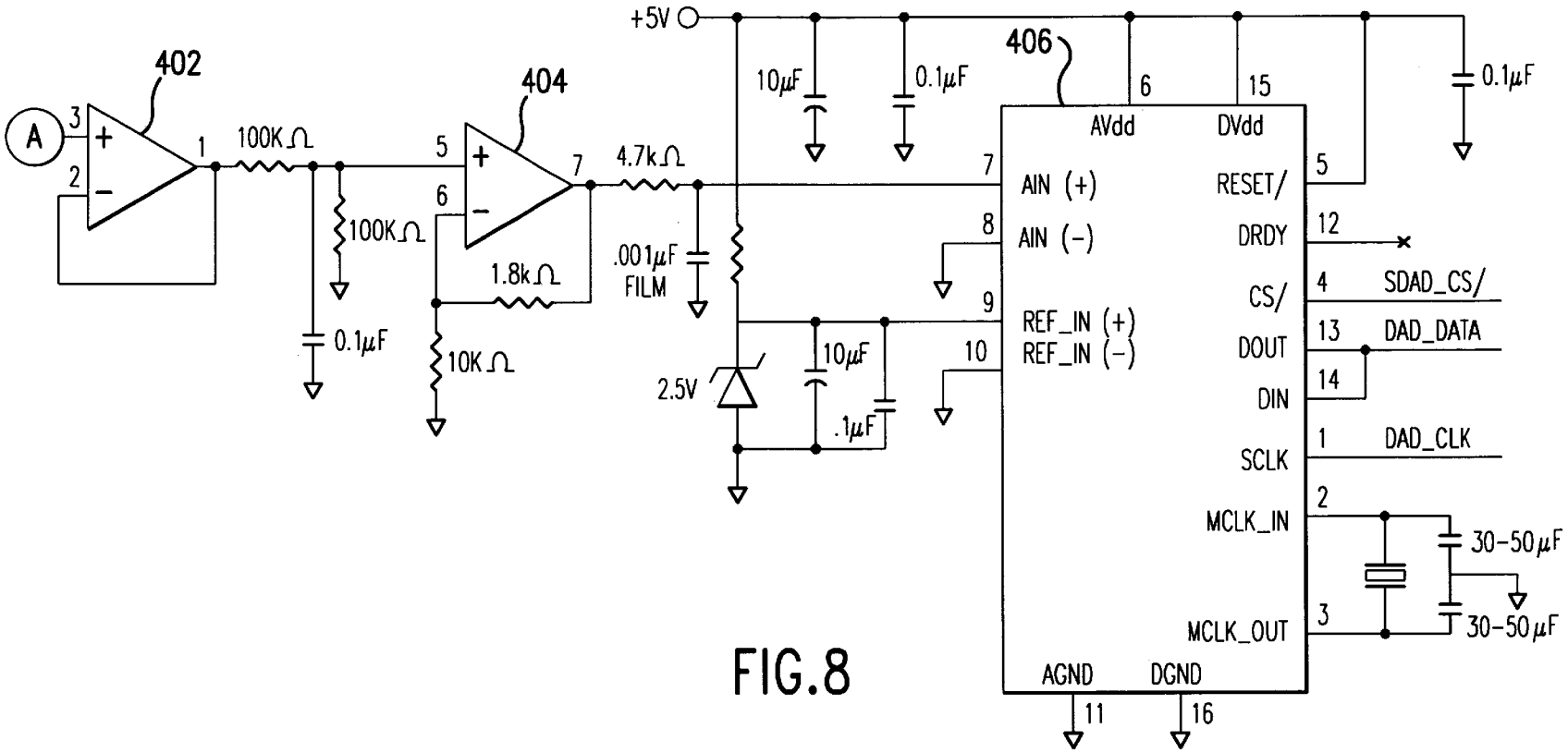
FIG. 8 shows a schematic diagram of an embodiment of an analog to digital conversion circuit for sampling a voltage in the circuit of FIG. 7.
Figure 9A:
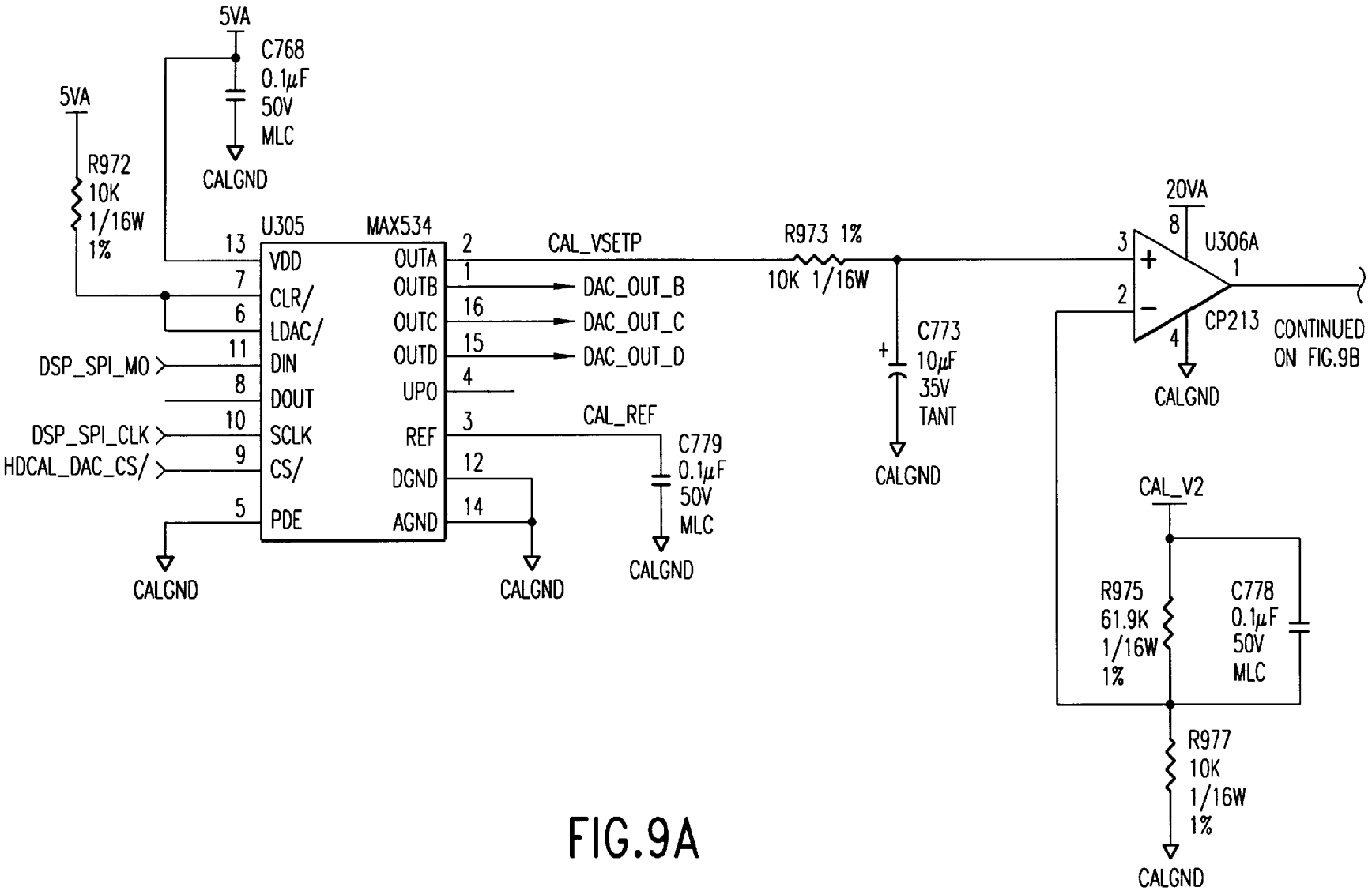
FIGS. 9A, 9B, 9C, 9D & 9E shows a schematic diagram of an embodiment of a high precision voltage generation circuit for measuring the resistance across thermal elements in the printhead shown in FIGS. 1 and 2 according to a second embodiment.
Figure 9B:
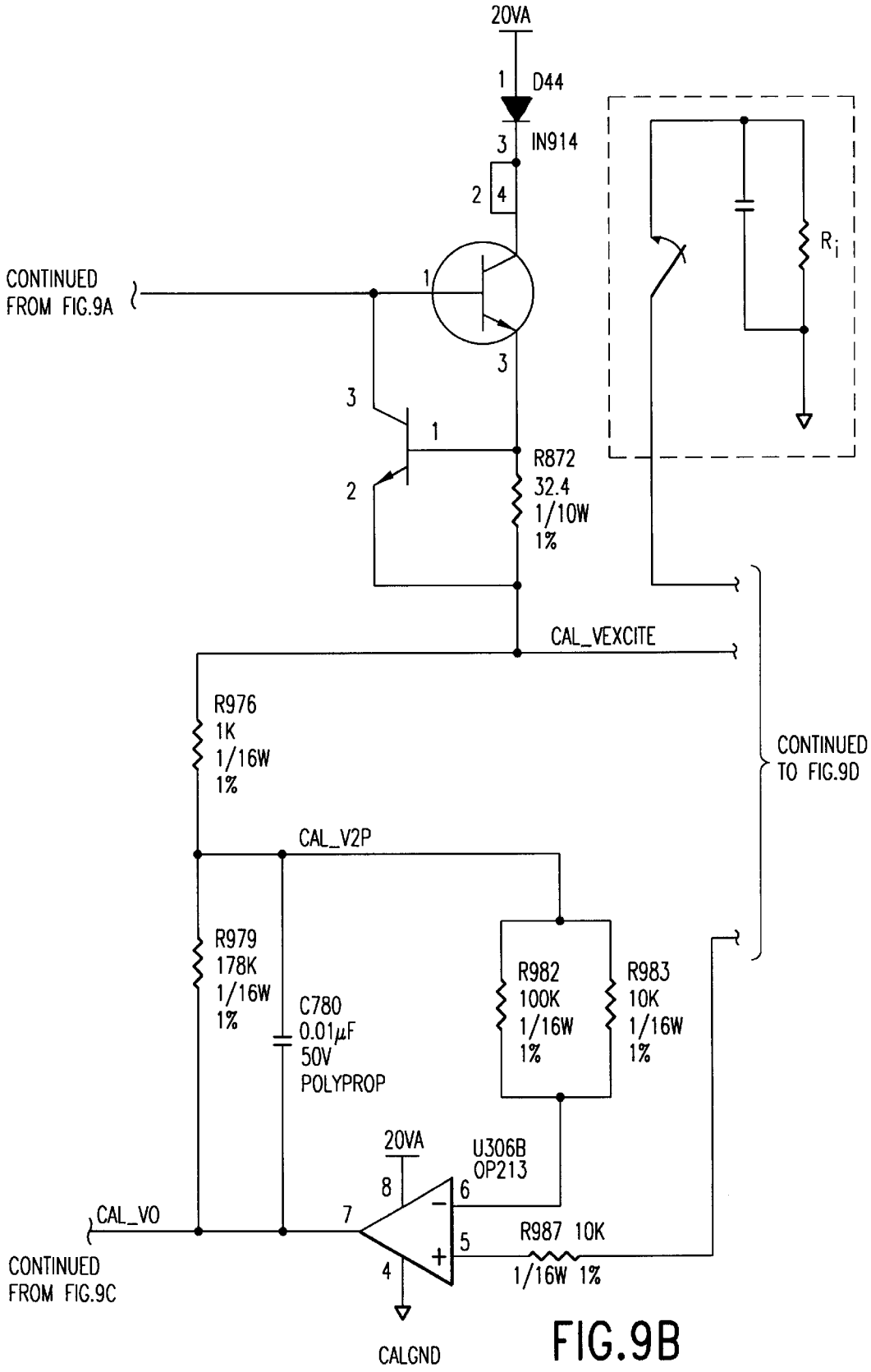
Figure 9C:
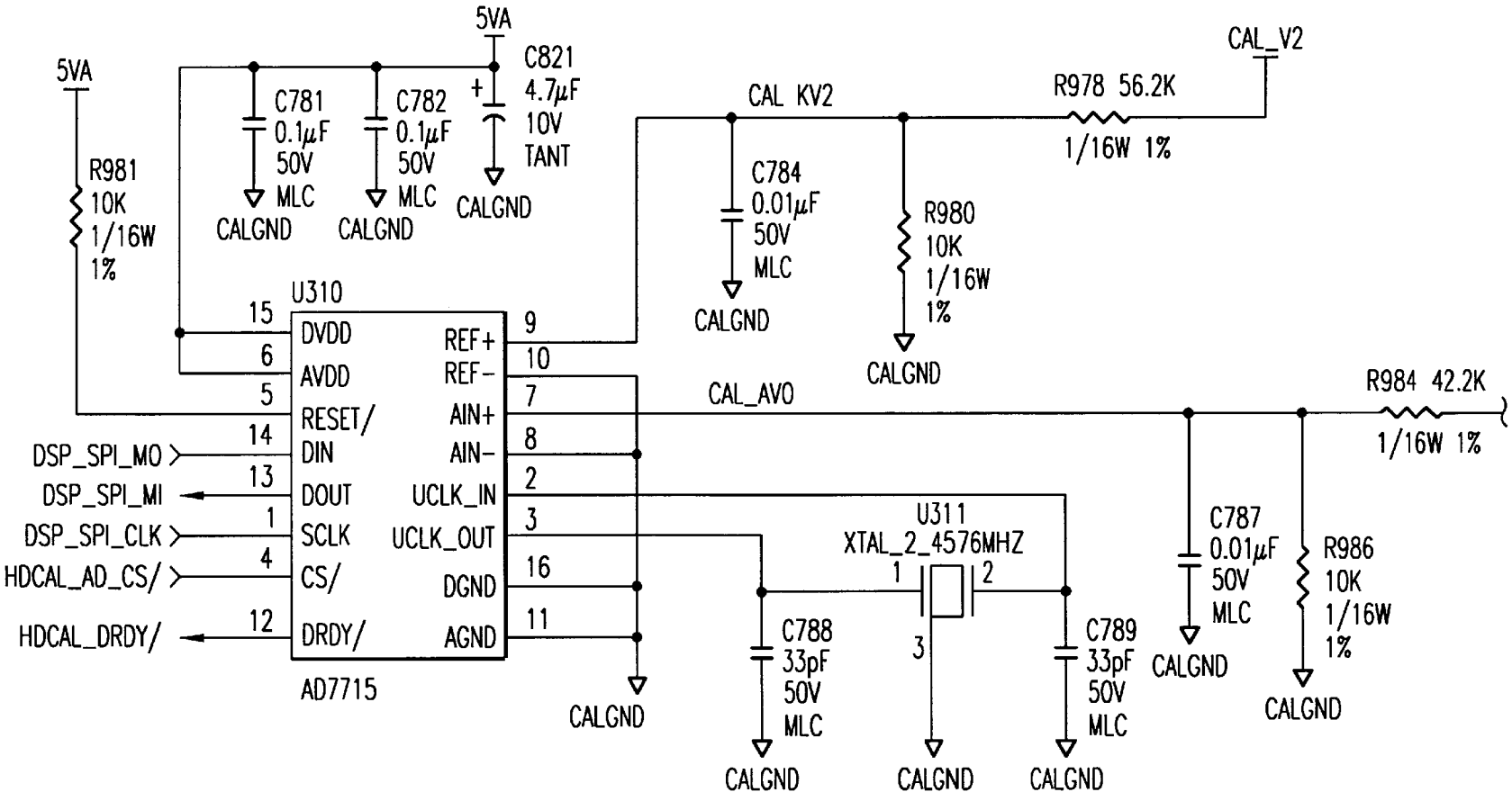
Figure 9D:
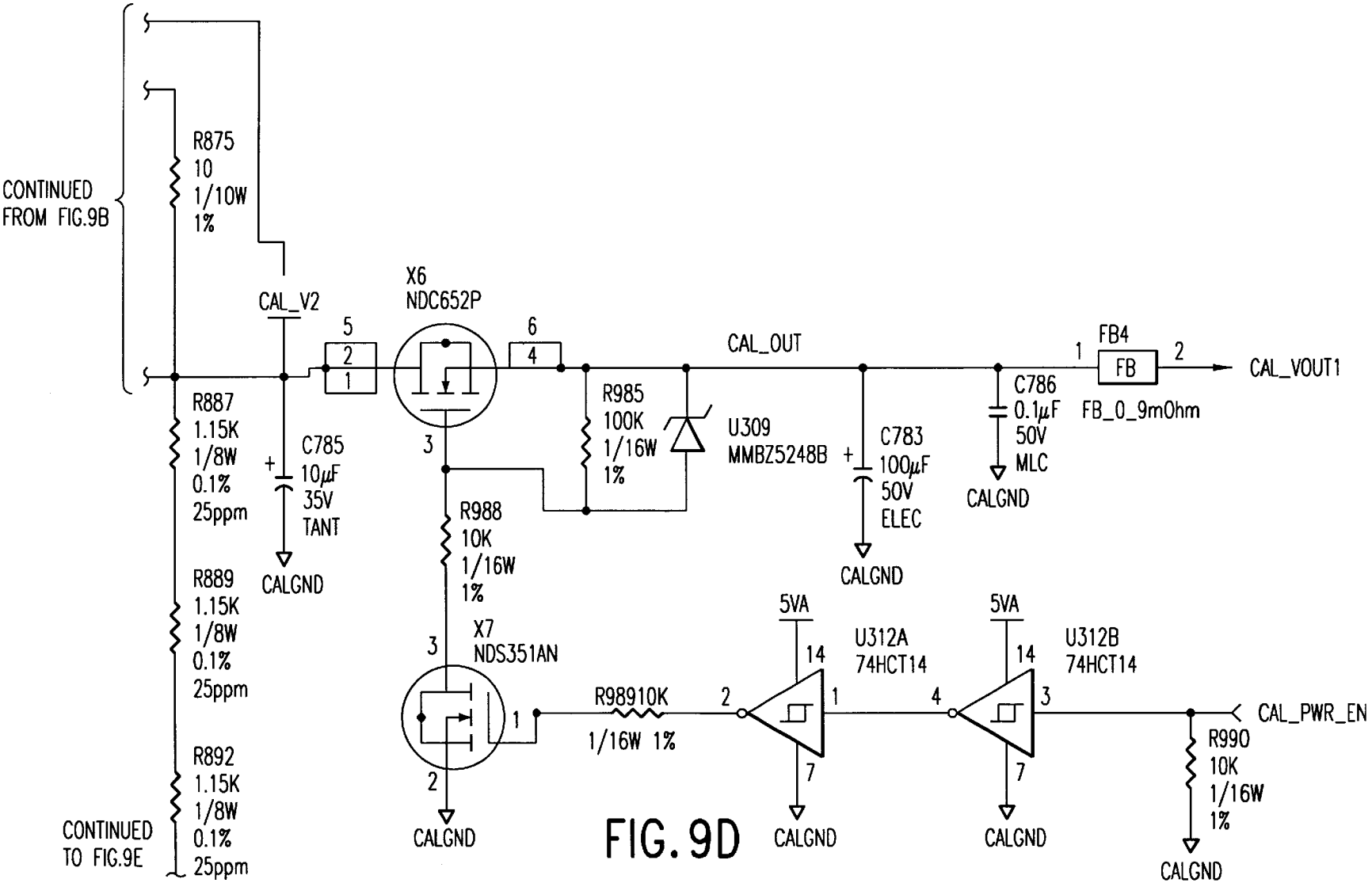
Figure 9E:
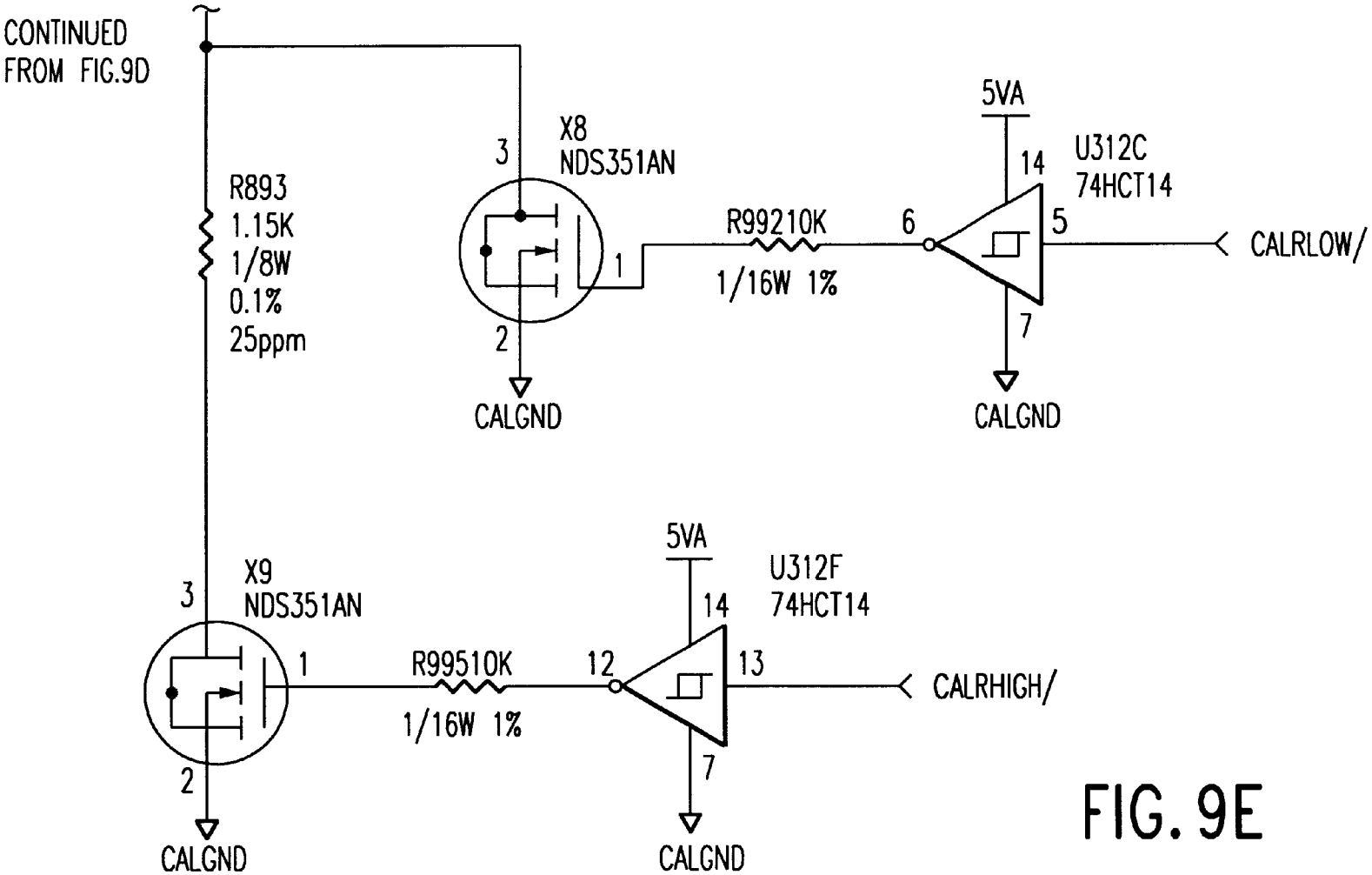

FIG. 8 shows a schematic diagram of an embodiment of an analog to digital conversion section which receives the voltage at the terminal A at the output of the circuit shown in FIG. 7. The schematic of FIG. 8 includes an analog to digital conversion chip 406 which may be an Analog Devices AD7715 integrated circuit. The chip 406 provides a sixteen bit serial output at a terminal 13 in response to a clock signal provided at terminal 1 and an input voltage at terminal 7. The voltage at terminal 7 is essentially the voltage at terminal A amplified by operational amplifiers 402 and 404. The sixteen bit output at the terminal 13 is representative of the voltage measures that cross the thermal element 308 shown in FIG. 7. Thus two sixteen bit outputs are provided at terminal 13 to correspond with each of the voltage measurements in response to the high current and the low current provided to the thermal element 308. Since the resistance value of $R_{fs}$ is known with precision, microprocessor computations may provide an estimate of the resistance of the thermal element 308 by dividing the voltage measured across the thermal element by the voltage measured across $R_{fs}$, and multiplying this quotient by the resistance value of $R_{fs}$.

Terminals 13 and 14 of the chip 406 provide a bidirectional data interface which allows the controlling logic to provide serial commands to the chip 406 such as commands for calibration of the circuit shown in FIG. 7 at the zero level and full level and for obtaining a sample of the voltage provided at terminal 7. In response to a command from the controlling logic for a sample, the chip 406 provides a serial word at terminal 13 which represents the sample voltage adjusted for the calibration voltages at zero calibration and full calibration.

FIG. 9 shows a schematic diagram of a circuit for measuring the resistances of the thermal elements using high precision voltages according to an embodiment. The circuit includes an actively-balanced wheatstone bridge. An element of the bridge being measured is either a thermal element or one of two precision reference resistors. The bridge is balanced by an operational amplifier so that two nodes of the bridge have equal voltage. The result is an output voltage that is proportional to the current through the circuit. A DC voltage regulator controls an excitation voltage of the bridge such that the output voltage, or voltage across thermal elements of the thermal printhead, is held constant. This is different from traditional bridge techniques in that a fixed-voltage node is at one of the comers of the bridge, rather than the excitation voltage, itself.

The second major portion is a DAC-controlled DC voltage regulator that regulates the voltage at the printhead by controlling the excitation voltage. The final portion is a sigma-delta A/D converter and voltage divider circuitry that presents the Vo and Vout voltages for ratiometric measurement.

A digital to analog converter (DAC) U305, such as the MAX534AC circuit sold by Maxim Integrated Products, Inc., provides a setpoint voltage that programs the voltage that is applied to the printhead for measurement purposes. The DAC U305 applies a stable DC voltage to a precision operational amplifier U306A. In the circuit, operational amplifier U306A, transistor X4, resistor R875, and a feedback network consisting of resistor R975, resistor R977, and capacitor C778 all combine to form a DC linear voltage regulator circuit that controls the DC voltage present at a node CAL_V2. The voltage at CAL_V2 is programmed by the DAC U305 such that the voltage at CAL_V2 will equal approximately 7.2 times the program voltage set by the DAC U305. CAL_V2 is the voltage that is applied to thermal elements of the printhead for measurement purposes. The programmable output voltage provided by this circuit allows measurement of the thermal elements of the printhead at multiple energy or temperature levels.

For embodiments in which calibration circuitry is on-board the imaging system (i.e., to perform on-going calibration after printhead installation), a transistor X6 allows the calibration voltage to be disconnected from the printhead during normal image imprinting operation. In this state, the main power supply voltage is applied to the printhead and could damage the calibration circuitry if it were left connected. When the X6 is transistor switched OFF, it removes the calibration circuitry from the printhead. During printhead calibration, the main power supply voltage to the printhead is disabled using a relay within the power supply, itself. The transistor X6 is then switched ON by raising the CAL_PWR_EN signal. Since the transistor X6 is a MOSFET switch that has very low resistance when ON, it does not substantially affect resistance measurements. Thus, during calibration, the voltages at CAL_VOUT1 and CAL_V2 are essentially equal.

Since the voltage applied to the printhead is applied directly across the thermal elements, the power applied to each thermal element during calibration is equal to CAL_VOUT1$^2$ / $R_{thermal}$, where $R_{thermal}$ is the resistance of the thermal element. Since CAL_VOUT1 is programmable, the resistance of the thermal elements may be measured at a plurality of energies and therefore a plurality of temperatures.

The resistors R875, R976, and R979 form three elements of an actively-balanced wheatstone bridge. The fourth element, which is the one to be measured, is either the resistance presented by a selected thermal element of the thermal printhead connected to CAL_VOUT1, or the precision reference resistors in the serial chain R887, R889, R892, and R893 connected to CAL_V2. The printhead and precision reference resistors present a parallel connection to the calibration voltage CAL_V2 (CAL_VOUT1). The resistors of the thermal printhead can be switched into and out of circuit using controlling logic. The precision reference resistors are switched into and out of circuit by controlling the CALRLOW/ and CALRHIGH/ signals. If CALRLOW/ is pulled low, then a precision resistance of 3.45 kOhms is switched into the circuit as the fourth element of the bridge. If CALRLOW/ is high and CALRHIGH/ is low, then a precision resistance of 4.6 kOhms is placed in circuit. These high and low precision resistance settings are used to calibrate the circuit by providing high- and-low readings that can be used to null any offset and leakage errors and to provide known standards by which the printhead resistance is compared.

Resistor R875 is the top-right element in the bridge. However, it is also in the feedback loop of the linear regulator circuitry. This has the effect of causing the right-most node of the bridge, CAL_V2, to be fixed and allowing CAL_VEXCITE, the bridge excitation voltage, to vary as required so that CAL_V2 is fixed.

An operational amplifier U306B provides an output as part of a feedback loop that controls the bottom-left node of the bridge forcing an active balance. Because of the balancing, the left and right nodes of the bridge, CAL_V2 and CAL_V2P, are forced to be about equal. This forces a voltage drop across R976 that is about equal to that across R875. As a result, the current through the left leg of the bridge (i.e., the current through resistor 976) is directly proportional to the current through the right leg (i.e., the current through resistor R875) and through the selected thermal element or sense resistor, whichever is in-circuit. Thus, the voltage developed across R979 is directly proportional to the current through the thermal element.

A sigma-delta analog to digital converter (ADC) U310 (such as the AD7715 circuit sold by Analog Devices, Inc.) measures the voltage drop across R979 indirectly by measuring the ratio of CAL_VO divided by CAL_V2. Resistor divider networks divide these voltages down to values than can be tolerated by the sigma-delta ADC U310. However these divider chains do not affect the results since they amount to a gain value that is accounted for by measuring the precision reference resistors R887 through R893. A capacitor C780 is preferably a polypropylene film capacitor that forms a low-pass filter, reducing the magnitude of signals at 60 Hz and above.

The calibration procedure is run by controlling logic, a microprocessor, a microcontroller, or any other digital method for managing digital processes. According to an embodiment in which calibration of the printhead is performed prior to installation in an imaging system, this controlling logic is preferably executed in an external microprocessor. According to the embodiment shown in FIG. 6, this controlling logic is executed in the print engine control processor 264. The calibration process is controlled by signals from the controlling logic as described below.

The system is designed to measure thermal element resistance at various levels of energy or temperature. This is accomplished by setting the measurement voltage of the system (the voltage applied to the thermal elements and to the reference resistors) to various known levels prior to each measurement pass of the printhead.

For a given measurement pass, the measurement voltage of the system, CAL_V2, is preferably programmed by setting the DAC U305 such that CAL_V2 is at the desired voltage. The controlling logic preferably programs DAC U305 through a serial communications bus DSP_SP_MO, DSP_SPT_CLK and HDCAL_DAC_CS/ as described in the manufacturer specification sheet for this component. The setting required for DAC U305 may be determined in a factory measurement step, or through the addition of another analog to digital converter that measures CAL_V2 directly and inputs the result into the controlling logic. Once the calibration voltage at CAL_V2 is set, the resistances of the thermal elements in the printhead may be measured one at a time.

The measurement of a resistance preferably includes a measurement of the reference resistances. This compensates for gain, offset, and leakage variances due to manufacturing tolerances, temperature, humidity, and the like. The printhead thermal elements are preferably switched out of circuit by pulling the STROBE/ signal high. This opens all FET switches in the printhead (e.g., switch transistors 252, FIG. 5), turning off all the thermal elements. An $R_{low}$ reference resistance, composed of the sum of resistors R887, R889, R892, is then inserted into the circuit by pulling the CALRLOW/ circuit low and raising CALRHIGH/ to a high level. The output of the sigma-delta ADC U310 is preferably sampled for a number of readings (typically 3 to 5) to allow the digital code for the resistance to reach a steady state. The controlling logic then stores the code for $R_{low}$ in memory.

Next, the $R_{high}$ reference resistance, comprised of the resistors in $R_{low}$ plus the resistance of R893, is switched into circuit and the $R_{low}$ resistance is switched out of circuit. This is done by raising CALRLOW/ and dropping CALRHIGH/. Once in circuit, the code for $R_{high}$ is read by allowing the sigma-delta ADC U310 to reach steady state by allowing enough time for 3 to 5 samples. Once steady state is reached, controlling logic stores the code for $R_{high}$ in memory. Little time is required to allow for thermal settling of reference resistors since these are of a low temperature coefficient type.

Once the measurement codes for reference resistors $R_{low}$ and $R_{high}$ are known (and stored in memory), the thermal elements of the printhead may be measured. This is accomplished by turning off the reference resistances by raising CALRLOW/ and CALRHIGH/ and coupling one thermal element at a time to the voltage at the node CAL_V2. To enable the thermal elements, the control lines to the thermal printhead are controlled in a manner well known in the art using 7 the circuitry as shown in FIG. 5 so that one element is programmed to ON at a time. Once this is done, the controlling logic enables the element by pulling the corresponding STROBE/ line low. This inserts a single thermal element into the circuit for measurement. The resistor is measured using the same process described for the reference resistances, in which the sigma-delta ADC 310 is given enough time to settle out and provide a corresponding code for the thermal element which is stored by the controlling logic. These samples are preferably taken after the voltage at CAL_V2 is applied at the thermal element for sufficient time so that the temperature of the thermal element reaches a steady state such as about 0.25 seconds.

The measurement of the reference resistances $R_{low}$ and $R_{high}$ is used to compensate for offset and gain errors in the circuit. The reference resistance readings take a snapshot of the circuit response at a specific point in time. When thermal elements are subsequently measured the reference resistance information is used to convert the readings to actual resistance values. Since the circuit may fluctuate over time due to thermal or other variation, the response of the circuit will change withtime. When the circuit changes, reading the reference resistors again is used for recalibrating the circuit. To achieve the best results the reference resistances are preferably measured as often as possible to produce measurements of the desired accuracy and precision. The frequency of compensation might be as infrequent as once for each fixed-voltage measurement pass of the printhead or as frequent as once for each thermal element. In the latter case, circuit drift is all but eliminated and very accurate, repeatable, and precise measurements of the thermal elements are produced.

The extracted codes in the measurement procedure at the sigma-delta ADC 310 do not directly indicate resistance. Instead, the resistance of the thermal elements are preferably calculated based upon the known value of the reference resistors, the extracted codes for the reference resistors and measured codes for the thermal elements in question. The extracted code can be shown to be linearly related to the inverse of the resistance under test.

$$CODE_{target} = m\frac{1}{R_{target}} + b \tag{4}$$

where: $CODE_{target}$: Digital value read from Sigma Delta ADC when measuring $R_{target}$.

m, b: Experimentally-determined constants.

$R_{target}$: Resistance

To determine a particular resistance, one must determine m and b. This is done by measuring the high and low reference resistances, $R_{high}$ and $R_{low}$. Doing so produces codes $CODE_{high}$ and $CODE_{low}$, respectively. Since the resistances of $R_{high}$ and $R_{low}$ are precisely known, m and b can be determined from the following relationships:

$$m = \frac{CODE_{low} - CODE_{high}}{\frac{1}{R_{low}} - \frac{1}{R_{high}}} \tag{5}$$

$$b = CODE_{low} - \frac{m}{R_{low}} \tag{6}$$

Once m and b are known, any other resistance attached between CAL_VOUT1 and ground, such as a printhead thermal element, can be measured as discussed above. The resistance of the thermal element is given by the following relationship:

$$R_i = \frac{m}{CODE_i - b} \tag{7}$$

where: $CODE_i$: Digital value read from Sigma Delta ADC when measuring the ith thermal element.

$R_i$: The measured resistance of the ith thermal element.

Measurements of the resistance $R_i$ of each of the i thermal elements are preferably obtained for at least two levels of temperature or energy. For example, a low energy measurement may be taken while applying a 5.0V across the thermal element i and a high-energy measurement may be taken while applying a 12.0V across the thermal element i. Accordingly, the preferred embodiment extracts corresponding values of $CODE_{low}$, $CODE_{high}$ and $CODE_i$ for each energy level used for measuring the resistance at the thermal element i.

The different voltages are generated by applying different inputs to the DAC U305 from the CPU through an eight bit signal DSP_SPI_MO to generate a corresponding voltage at signal CAL_VSETP. This will then allow a measurement of the resistance of each thermal element i at multiple energy levels as inputs to equations (2) and (3) (i.e., $Rl_i$ and $Rh_i$).

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A method of calibrating a thermal printhead to be incorporated into an imaging system for transferring images to media by applying power to the printhead, the printhead having a thermal element, the thermal element having a resistance and a pixel imaging surface, the method comprising:

measuring the resistance of the thermal element at a plurality of temperatures or energy levels to provide an associated plurality of resistance measurements; and establishing or maintaining a temperature or energy dependent profile for the thermal element based upon the associated plurality of resistance measurements, wherein the temperature or energy dependent resistance profile varies over at least a portion of an operational temperature or energy range of the thermal element.

2. The method of claim 1, the method further comprising pre-aging the thermal element by applying energy to the printhead to stabilize resistive material which provides the resistance prior to measuring the resistance of the thermal element.

3. The method of claim 1, said measuring including:

applying one of a first current and a first voltage to the thermal element to maintain the thermal element at a first temperature or energy level;

measuring the resistance of the thermal element at the first temperature or energy level to provide a first associated resistance measurement;

applying one of a second current and a second voltage to the thermal element to maintain the thermal element at a second temperature or energy level; and measuring the resistance of the thermal element at the second temperature or energy level to provide a second associated resistance measurement and further wherein said establishing or maintaining is based upon said first associated resistance measurement and said second associated resistance measurement.

4. The method of claim 1, wherein said measuring further includes:

applying a set voltage across the resistance of the thermal element; and measuring a current through the resistance of the thermal element in response to the set voltage.

5. The method of claim 1, wherein said measuring further includes:

providing a set current through the resistance of the thermal element; and measuring a voltage across the resistance of the thermal element in response to the set current.

6. The method of claim 1, the method further comprising applying a pulse width modulation signal to the thermal element to change the temperature or energy level of the thermal element.

7. The method of claim 1, wherein the thermal element has a capacitance, the method further comprising applying a capacitive discharge of the capacitance of the thermal element to the thermal element to change the temperature or energy level of the thermal element.

8. A method of transferring an image to media from a thermal printhead, the printhead having a thermal element, the thermal element having a resistance and a pixel imaging surface, the method comprising:

estimating a level of energy of the thermal element based upon a density of pixels in a desired image;

estimating the resistance associated with the thermal element based upon the estimated level of energy and a temperature or energy dependent resistance profile associated with the thermal element, the temperature or energy dependent resistance profile varying over at least a portion of an operational temperature or energy range of the thermal element; and calculating an amount of energy to be applied to the thermal element based upon the estimated resistance.

9. The method of claim 8, the method further including applying the energy to the thermal element to transfer an image onto thermal reactive media.

10. The method of claim 8, the method further including applying the calculated energy to the thermal element to transfer dye to media as part of a dye diffusion process.

11. The method of claim 8, the method further including applying the calculated energy to the thermal element to transfer wax to media as part of a thermal wax transfer process.

12. The method of claim 8, wherein the printhead has a plurality of thermal elements, and wherein said plurality of thermal elements are formed in a row such that the individual pixel imaging surfaces form a linear imaging surface, the method further including:

translating a media surface over the printhead in a direction which is substantially perpendicular to the row of thermal elements;

selecting individual thermal elements at discrete time intervals to provide an image on the media at a desired intensity; and sequentially calculating an amount of energy to be applied to each of the selected individual thermal elements at the time intervals based upon the associated estimated resistance and the desired intensity or energy level.

13. The method of claim 12, the method further including sequentially applying the calculated energy to the selected thermal elements at the time intervals.

14. The method of claim 8, wherein the printhead has a plurality of thermal elements, each thermal element having a resistance and a pixel imaging surface, and the method further including selecting the thermal element from among the plurality of thermal elements based upon a digital representation of a desired image.

15. An imaging system for transferring an image to media from a thermal printhead, the printhead having a thermal element, the thermal element having a resistance and a pixel imaging surface, the imaging system comprising:

logic for estimating one of an energy level and a temperature to be applied to the thermal element;

logic for estimating the resistance associated with the thermal element based upon the estimated temperature or energy level and a temperature or energy dependent resistance profile associated with the thermal element, the temperature or energy dependent resistance profile varying over at least a portion of an operational temperature or energy range of the thermal element; and logic for calculating an amount of energy to be applied to the thermal element based upon the estimated resistance.

16. The imaging system of claim 15, the imaging system further including a circuit configured to apply the calculated energy to the selected thermal element to transfer an image onto thermal reactive media.

17. The imaging system of claim 15, the imaging system further including a circuit configured to apply the calculated energy to the selected thermal element to transfer dye to media as part of a dye diffusion process.

18. The imaging system of claim 15, the imaging system further including a circuit configured to apply the calculated energy to the selected thermal element to transfer wax to media as part of a thermal wax transfer process.

19. The imaging system of claim 15, wherein the printhead has a plurality of thermal elements, and wherein said plurality of thermal elements are formed in a row such that the individual pixel imaging surfaces form a linear imaging surface, the imaging system further including:

a media feed configured to translate a media surface over the printhead in a direction which is substantially perpendicular to the row of pixels;

logic configured to select individual thermal elements at discrete time intervals to provide an image on the media at a desired intensity; and logic configured to sequentially calculate an amount of energy to be applied to each of the selected individual thermal elements at the time intervals based upon the associated estimated resistance, the desired intensity and the estimated temperature or energy level of the selected thermal element.

20. The imaging system of claim 19, the imaging system further including logic for sequentially applying the calculated energy to the selected thermal elements at the time intervals.

21. The imaging system of claim 15, wherein the printhead has a plurality of thermal elements, each thermal element having a resistance and a pixel imaging surface, and the imaging system further including logic configured to select the thermal element from among the plurality of thermal elements based upon a digital representation of a desired image.

22. The imaging system of claim 15, the imaging system further comprising a circuit for applying a pulse width modulation signal to the thermal element to change the temperature or energy level of the thermal element.

23. The imaging system of claim 15, wherein the thermal element has a capacitance and further wherein the temperature or energy level of the thermal element is changed by discharging a current from the capacitance through the resistance of the thermal element.

24. A system for calibrating a thermal printhead to be incorporated into an imaging system for transferring images to media by applying power to the printhead, the printhead having a thermal element, the thermal element having a resistance and a pixel imaging surface, the system comprising:

a measurement circuit configured to measure the resistance of the thermal element at a plurality of temperatures or energy levels to provide an associated plurality of resistance measurements; and logic establishing or maintaining a temperature or energy dependent resistance profile for the thermal element based upon the associated plurality of resistance measurements, wherein the temperature or energy dependent resistance profile varies over at least a portion of an operational temperature or energy range of the thermal element.

25. The system of claim 24, the system further comprising a circuit configured to pre-age the thermal element by applying energy to the printhead to stabilize resistive material which provides the resistance.

26. The system of claim 24, the measurement circuit including:

a circuit configured to apply one of a first current and a first voltage to the thermal element to maintain the thermal element at a first temperature or energy level;

a circuit configured to measure the resistance of the thermal element at the first temperature or energy level to provide a first associated resistance measurement;

a circuit configured to apply one of a second current and a second voltage to the thermal element to maintain the thermal element at a second temperature or energy level; and a circuit configured to measure the resistance of the thermal element at the second temperature or energy level to provide a second associated resistance measurement, and further wherein said temperature or energy dependent resistance profile is based upon said first associated resistance measurement and said second associated resistance measurement.

27. The system of claim 24, wherein the measurement circuit further includes:

a circuit configured to apply a set voltage across the resistance of the thermal element; and a circuit configured to measure a current through the resistance of the thermal element in response to the set voltage.

28. The system of claim 24 wherein the measurement circuit further includes:

a circuit configured to provide a set current through the resistance of the thermal element; and a circuit configured to measure a voltage across the resistance of the thermal element in response to the set current.

* * * * *